US008671820B1

(12) United States Patent
Keyfauver et al.

(10) Patent No.: US 8,671,820 B1
(45) Date of Patent: Mar. 18, 2014

(54) SOFT BALLISTIC SHIELDS

(75) Inventors: Kent Keyfauver, Alta Loma, CA (US); Felix Colon, Pompano Beach, FL (US)

(73) Assignee: Kent Kayfauver, Alta Loma, CA (US)

( * ) Notice: Subject to any disclaimer, the term of this patent is extended or adjusted under 35 U.S.C. 154(b) by 3 days.

(21) Appl. No.: 13/440,826

(22) Filed: Apr. 5, 2012

Related U.S. Application Data

(63) Continuation of application No. 12/778,968, filed on May 12, 2010, now Pat. No. 8,210,088.

(60) Provisional application No. 61/474,615, filed on Apr. 12, 2011, provisional application No. 61/263,313, filed on Nov. 20, 2009.

(51) Int. Cl.
*F41H 5/00* (2006.01)
*F41H 5/08* (2006.01)

(52) U.S. Cl.
USPC ..... 89/36.05; 89/36.07; 89/918; 89/939

(58) Field of Classification Search
USPC ..... 89/36.01, 36.02, 36.05, 36.07; 102/303; 2/2.5; 428/911; D29/100
See application file for complete search history.

(56) References Cited

U.S. PATENT DOCUMENTS

| | | | | |
|---|---|---|---|---|
| 626,402 | A | 6/1899 | Zinn | |
| 1,273,371 | A | 7/1918 | Hudziak | |
| 2,347,653 | A | 5/1944 | Zuckermann | |
| 2,370,596 | A | 2/1945 | Wallace | |
| 2,748,391 | A | 6/1956 | Lewis | |
| 3,491,847 | A * | 1/1970 | Abbott | 180/271 |
| 3,745,938 | A | 7/1973 | Hathaway et al. | |
| 3,801,416 | A | 4/1974 | Gulbierz | |
| 3,814,016 | A * | 6/1974 | Leach et al. | 102/303 |
| 4,412,495 | A | 11/1983 | Sankar | |
| 4,475,247 | A | 10/1984 | Lee | |
| 4,546,863 | A | 10/1985 | Kaufman | |

(Continued)

FOREIGN PATENT DOCUMENTS

| | | |
|---|---|---|
| FR | 2607241 A1 | 5/1988 |
| JP | 7243797 | 9/1995 |
| JP | 7305999 | 11/1995 |

OTHER PUBLICATIONS

Photographs of Shield Device sold to Riverside County in or around Mar. 2008 in 2 pages.

(Continued)

*Primary Examiner* — Bret Hayes
(74) *Attorney, Agent, or Firm* — Knobbe Martens Olson & Bear, LLP

(57) ABSTRACT

A soft ballistic shield comprises a shell adapted to support at least one soft ballistic panel made from a soft ballistic material suitable for protecting a user from bodily injury from projectiles. At least one generally horizontal support is adapted to be coupled to the shell in a deployed configuration. First and second generally vertical supports are adapted to be coupled to the shell in a deployed configuration. The first and second generally vertical pockets cover a majority of the first and second generally vertical supports when housing the first and second generally vertical supports in a deployed configuration to provide a support structure for the soft ballistic shield to absorb energy from an impact of a projectile. A retainer cap is coupled to the shield and configured to be positioned over an end of the at least one elongate generally horizontal support.

20 Claims, 17 Drawing Sheets

(56) References Cited

U.S. PATENT DOCUMENTS

| | | | | |
|---|---|---|---|---|
| 5,044,252 | A | 9/1991 | Gamadi et al. | |
| 5,076,168 | A * | 12/1991 | Yoshida et al. | 102/303 |
| 5,377,577 | A | 1/1995 | Bounkong et al. | |
| 5,392,686 | A | 2/1995 | Sankar | |
| 5,413,026 | A | 5/1995 | Madden, Jr. | |
| 5,756,922 | A | 5/1998 | Fuller | |
| 5,996,115 | A | 12/1999 | Mazelsky | |
| 6,161,462 | A | 12/2000 | Michaelson | |
| 6,389,949 | B1 | 5/2002 | Carreira | |
| 6,581,505 | B1 | 6/2003 | Levell | |
| 6,595,101 | B2 | 7/2003 | Baker | |
| 6,691,601 | B2 | 2/2004 | Cohen et al. | |
| 6,807,890 | B1 | 10/2004 | Fuqua | |
| 7,216,644 | B2 | 5/2007 | Haugen | |
| 7,302,880 | B1 | 12/2007 | Elasic | |
| 7,389,718 | B1 | 6/2008 | Carter et al. | |
| 7,424,844 | B2 | 9/2008 | Carter | |
| 7,520,207 | B1 | 4/2009 | Fuqua et al. | |
| 8,210,088 | B1 * | 7/2012 | Keyfauver | 89/36.05 |
| 8,256,020 | B2 * | 9/2012 | Dovner et al. | 2/2.5 |
| 2002/0092416 | A1 | 7/2002 | Cohen et al. | |
| 2002/0104429 | A1 | 8/2002 | Euler | |
| 2005/0217472 | A1 | 10/2005 | Baker | |
| 2005/0257678 | A1 | 11/2005 | Camp | |
| 2006/0230916 | A1 | 10/2006 | Sand | |
| 2007/0193441 | A1 | 8/2007 | Carter | |

OTHER PUBLICATIONS

Photographs of Shield Device sold to Mountain View Police Department on Feb. 13, 2009 in 3 pages.
Go Shield brochure, by Kent Keyfauver, 2009, in 2 pages.
The Rhino brochure, by Len Christensen, received on Mar. 17, 2010, in 2 pages.

* cited by examiner

SOFT BALLISTIC SHIELDS

REFERENCE TO RELATED APPLICATIONS

The present application is a continuation-in-part of U.S. Non Provisional application Ser. No. 12/778,968 filed May 12, 2010 entitled "Soft Ballistic Shields," and claims the benefit of U.S. Provisional Application No. 61/263,313 filed Nov. 20, 2009, entitled "Soft Ballistic Shield," including the Appendix attached thereto, and claims the benefit of U.S. Provisional Application No. 61/474,615 filed Apr. 12, 2011, entitled "Soft Ballistic Shields." The entire disclosures of each of the foregoing applications, and any attachments thereto, are hereby incorporated by reference herein.

BACKGROUND

Law enforcement professionals utilize shields as physical barriers to protect their bodies during hostile engagements. For example, shields may be used to stop bullets from striking an officer's torso. Law enforcement professionals use shields in any number of situations with any number of physical settings to protect themselves from gunfire and other projectiles. One type of shield available is a hard shield that does not easily flex or bend.

Hard shields may be manufactured similarly to ballistic helmets. Ballistic helmets must be manufactured in a variety of different sizes to accommodate a variety of different heads. Similarly, one size may not fit all when using hard shields. Some officers are taller or shorter than others, and the standard length of a hard shield cannot easily provide effective or adequate protection for different heights. Also, hard shields may not easily change lengths to accommodate particular shield uses, and changing lengths of a hard shield may not be economically viable.

Also, as hard shields generally do not collapse into a smaller size, storage is a problem for hard shields. A hard shield cannot easily be stored in a trunk or a compartment of a vehicle. Storage room is at a premium because of the gear that is used much more frequently than a hard shield. Further, hard shields are subject to excessive wear and tear as the hard materials do not easily absorb abuse. Therefore, the resins that bind the hard shield's components can crack and the rubber edges of the hard shield can fall off.

Hard shields are also heavy and awkward structures and are therefore not user friendly when trying to effectively use weapons systems and maneuver while taking hostile gunfire. Hard shields may impair users from moving with balance and speed as they must manipulate a large heavy, and awkwardly shaped structure extended from their hands. Prolonged searches may be difficult due to the weight of the hard shield. Hostage situations are usually prolonged standoffs, and a heavy shield may become a burden. If an officer bumps the hard shield it may create a loud noise which may give away the officer's position. Frequently, hard shields are not taken into the field because these drawbacks outweigh the benefits of the added protection.

Some in the industry have attempted to provide soft shields that can overcome the drawbacks presented by a hard shield. For example, some soft shields have been constructed from a ballistic resistant fabric shell that is supported at limited locations by support bars. However, these soft shields have not been satisfactory in some cases.

SUMMARY

One aspect of the present disclosure is the realization and recognition that available soft shield designs present an unacceptable level of risk of injury to the user. Recent testing of existing soft shield designs utilizing a fabric shell and support bars attached to the shell at limited locations has revealed that these models provide inadequate protection against projectiles. It has been discovered that current designs may collapse in certain circumstances when hit by projectiles. For example, the outer edge of the fabric shell may buckle or bend back allowing a projectile to slide past the barrier.

This may provide an unsafe environment or a false sense of security for law enforcement professionals using soft shields constructed according to existing designs. Accordingly, one aspect of the present disclosure is the realization and recognition that there is a need for a fabric shell soft shield and associated support structure that resists collapsing upon bullet impact, particularly at locations along an edge of the soft shield. Thus, a need in the art exists in order to develop a simple and effective soft shield design that provides adequate ballistic protection still retaining a lightweight, flexible, and collapsible design.

Described herein are soft shield fabric shell and support frame designs that address the recently discovered inadequacy of soft shell designs by providing increased protection and stability while overcoming the many drawbacks of prior technologies and providing new advantages. Some embodiments of the soft shield of the present disclosure include a shell and a support frame that includes two vertical supports and two horizontal supports. In some embodiments, the vertical supports may be secured to the shell through two vertical pockets that are open on the top and cover a majority of the vertical supports. In some embodiments, an upper horizontal support may be fastened to the shell with straps that wrap around the horizontal support. In an embodiment, a lower support may be at least partially enclosed in a lower pocket. In still other embodiments, the vertical pockets may also include elastic bands integrated or on top of the vertical pockets that provide further friction and support to hold the vertical supports in place.

Testing has demonstrated that this support design provides superior resistance and protection from projectiles including bullets and does not as readily collapse or allow projectiles to slide past the barrier. Advantageously, this design also utilizes few rigid components, including only four hard supports. This allows the system to be very lightweight and flexible to conform to a law enforcement professional's body to provide excellent maneuverability in hostile engagements.

In some embodiments, ballistic panels may be inserted into the shell to provide protection from projectiles. In some embodiments, these panels may have a waterproof cover to preserve the ballistic panels in moist environments. In some embodiments, the ballistic panels may be inserted through the bottom of the shell. In still other embodiments, the ballistic panels may be secured with VELCRO® flaps inside of the shell.

In some embodiments, handles may be attached to the shell to provide a law enforcement officer a grip to position the shield during hostile engagements. In some embodiments, a connection may be provided on a soft shield to connect a sling so that the shield may be carried while not in use or strapped to the body for hands free use. In some embodiments, sectional strapping may be applied to the shell to allow snap on connectors or rings to be attached to the shell. In some embodiments, a sling may be attached to the various rings or connectors attached to the sectional strapping to allow the shield to be worn or utilized in different ways to accommodate different hostile engagement situations.

In some embodiments, unlike a hard shield, the width or length of a soft shield may be adjusted, depending on the requirements of a situation to provide greater versatility to the scenarios in which the soft shield may be employed. In some embodiments fasteners allow the shield to be folded into a smaller size and pull tabs may be used to re-deploy the shield to full size and remove the folded portions from the fasteners.

Some embodiments include a flap for hanging the soft shield. In some embodiments the flap may be wrapped around a pole or beam, or other structure and attached with fasteners to another portion of the flap or the shell to secure the soft shield in place. Some embodiments also utilize metal eyelets for easy ventilation of the shell and to allow the air to escape the shell on impact and therefore more effectively absorb and dissipate the energy from the impact of a projectile.

In still other embodiments the shell may have a front side plate pocket, in which a hard armor plate may be inserted or secured. This will provide resistance to especially large impulses or forceful impacts. In some embodiments an identification placard may be attached to the shell to increase coordination of efforts and assist members of a law enforcement team responding to an active shooter or in order to assert psychological pressure on attackers. In still other embodiments, a light source may be attached to the shell or a ballistic viewing port may be installed in the shell. In some embodiments, magnets may be used to allow the shield to be temporarily positioned on a metal structure such as a car door to provide a temporary barrier for an officer to stand behind without having to support the shield.

According to one embodiment, a soft ballistic shield for protecting law enforcement officers from bodily harm from projectiles comprises a shell with four sides and at least four nylon support rods. At least two of the nylon support rods are configured to be oriented in a generally vertical direction. At least two of the nylon support rods configured to be oriented in a generally horizontal direction. The rods are adapted to form an approximately rectangular frame near an edge of the four sides of the shell. Two elastic bands are attached to the shell and adapted to secure a top one of the two nylon support rods oriented in a generally horizontal direction to the shell. Two nearly full length rod pockets are attached to the shell and adapted to secure the two nylon support rods oriented in a generally vertical direction to the shell. There is an opening near the top of the pocket for easy removal of the two nylon support rods oriented in a generally vertical direction. A full length pocket is attached to the shell and adapted to secure a bottom one of the two nylon support rods oriented in a generally horizontal direction to the shell. In some embodiments the pocket fully encloses the bottom one of the two nylon support rods oriented in a generally horizontal direction. In some embodiments the pocket partially encloses the bottom one of the two nylon support rods oriented in a generally horizontal direction. In some embodiments the pocket comprises one or more elastic tension elements. A generally horizontally oriented storage pocket is attached to the shell for storage of the two nylon support rods configured to be oriented in a generally vertical direction while not deployed in the generally vertical direction. At least one soft ballistic panel made from a soft ballistic material is secured to the shell in a water tight cover attached to the shell. A flap is located near a top of the shell with fasteners on the flap and on the shell to enable the shield to be secured to an object. An upper handle and a lower handle each connect to the shell for arm carrying and holding the shield. Two metal rings are attached to each end of the upper handle attached to the shell. A sling is provided, with each end of the sling attached to one of the two metal rings with a spring loaded metal snap latch that may be quickly disconnected. Metal eyelets are associated with the shell and are positioned at corners of the shell. A front side plate pocket is associated with the shell. A hard armor plate is provided that may be inserted into the front side plate pocket.

According to another embodiment, a soft ballistic shield for protecting law enforcement officers from bodily harm from projectiles comprises a shell configured to support at least one soft ballistic panel made from a soft ballistic material suitable for protecting a user from bodily injury from projectiles. The shell has four sides. The shield has at least four support rods. Two support rods are configured to be oriented in a generally vertical direction when in a deployed configuration and two of the support rods are configured to be oriented in a generally horizontal direction when in a deployed configuration. The support rods are adapted to form an approximately rectangular frame for supporting the shell near the four sides of the shell. At least one elastic band is coupled to an upper portion of the shell and is adapted to secure a top one of the two support rods oriented in a generally horizontal direction to the shell in a deployed configuration. First and second nearly full length rod pockets are coupled to first and second side portions of the shell and are oriented in a generally vertical direction when in a deployed configuration. The first and second rod pockets are adapted to secure the two support rods oriented in a generally vertical direction to the shell when in a deployed configuration. The first and second rod pockets have openings near the top portions of the pockets for insertion and removal of the two support rods. A full length rod pocket is coupled to a lower portion of the shell and adapted to secure a bottom one of the two support rods oriented in a generally horizontal direction to the shell. The full length rod pocket fully encloses the bottom one of the two support rods oriented in a generally horizontal direction when in a deployed configuration. A generally horizontally oriented storage pocket is coupled to the shell for storage of the two support rods configured to be oriented in a generally vertical direction, when not deployed in the generally vertical direction. A flap is coupled near a top of the shell with fasteners on the flap and on the shell to enable the shield to be secured to an object. At least one handle is coupled to the shell for arm carrying and holding the shield. At least first and second rings are attached to ends of the handle coupled to the shell. A sling has a first end and a second end. Each end of the sling is adapted to be coupled to one of the first and second rings by a quick release connection mechanism. A front side plate pocket is coupled with the shell and adapted to support a hard armor plate to protect against higher powered projectiles. In some embodiments, the shell is about 20 inches in width and about 30 inches in length. In other embodiments, the shell is about 20 inches in width and about 40 inches in length.

According to another embodiment, a soft shield for protection of law enforcement officers comprises a shell adapted to support at least one soft ballistic panel made from a soft ballistic material suitable for protecting a user from bodily injury from projectiles. The shell has a stored configuration and at least first and second deployed configurations. At least one elongate generally horizontal support is associated with the shell is made from a semi-rigid material and capable of supporting the shell to absorb the impact of a projectile. At least two elongate generally vertical supports are constructed of a semi-rigid material and capable of supporting the shell to absorb the impact of a projectile. At least two generally vertical pockets are coupled to the shell and are adapted to house the at least two generally vertical supports in the deployed configurations. The generally vertical pockets provide support to the shell when the vertical supports are housed inside the generally vertical pockets. At least one pocket is coupled to the shell and is adapted to store the at least two elongate generally vertical supports when the shell is in the stored configuration. A foldable shield portion is coupled to a lower portion of the shell. The foldable shield portion is adapted to be folded up in the first deployed configuration to provide a shield of a first length. The foldable shield portion is adapted to be unfolded in the second deployed configuration to provide a shield of a second length. The second length is greater than the first length.

According to another embodiment, a soft ballistic shield comprises a shell adapted to support at least one soft ballistic panel made from a soft ballistic material suitable for protecting a user from bodily injury from projectiles. At least one generally horizontal support is adapted to be coupled to the shell for providing support to the soft ballistic shield when the soft ballistic shield is in a deployed configuration. The at least one generally horizontal support is made from a semi-rigid material. First and second generally vertical supports are adapted to be coupled to the shell for providing support to the soft ballistic shield when the soft ballistic shield is in a deployed configuration. The first and second generally vertical supports are made from a semi-rigid material. First and second generally vertical pockets are provided for removably housing the first and second generally vertical supports coupled to the shell. The first and second generally vertical pockets cover a majority of the first and second generally vertical supports when housing the first and second generally vertical supports in a deployed configuration to provide a semi-rigid support structure for the soft ballistic shield adapted to absorb energy from an impact of a projectile. In some embodiments, the first and second generally vertical supports are rods. In some embodiments, at least one elastic band is coupled to the first and second generally vertical pockets. In some embodiments, the first and second generally vertical pockets are angled relative to an edge portion of the shell. In some embodiments, upper portions of the first and second generally vertical pockets are flared.

According to another embodiment, a soft shield for protection of law enforcement officers comprises a shell with an upper portion, a middle portion and a lower portion, the lower portion being foldable upwardly toward the middle portion. A lower fastener is attached to the lower portion of the shell and a first middle fastener is attached to a middle portion of the shell. A second middle fastener is attached to a middle portion of the shell generally above the first middle fastener. The lower fastener is releasably connectable to either the first middle fastener or the second middle fastener in order to shorten the length of the shell and retain the shell in a folded position. There are at least two horizontal supports associated with the shell. There are at least two vertical supports. At least two vertical pockets house at least two vertical supports in a deployed configuration.

According to another embodiment, a soft shield for protection of law enforcement officers comprises a tough fabric shell configured to incorporate various components of a soft ballistic shield for providing a substrate for various components of the soft shield. At least two elongate horizontal rods are associated with the shell and are made from a semi-rigid material and are capable of absorbing the impact of a projectile. At least two elongate vertical rods are constructed of a semi-rigid material and are capable of absorbing the impact of a projectile. At least two vertical pockets removably house the at least two vertical supports. The vertical pockets are constructed of a tough material that is capable of absorbing the impact from a speeding projectile and providing support to the soft shield when the vertical supports are housed inside the vertical pockets. A first fastener and a second fastener are associated with the shell so that the shell may be folded and the first fastener may be removably attached to the second fastener in order to shorten the length of the shell. A flap is provided on an upper portion of the shell. The flap includes a third fastener so that the shell may be rolled up and the third fastener may be attached to a fourth fastener associated with the shell in order to secure the shell in a rolled position.

According to another aspect, a method of storing a soft shield comprises the steps of providing a shell adapted to support at least one soft ballistic panel made from a soft ballistic material. At least one generally horizontal support is adapted to be coupled to the shell for providing support to the soft ballistic shield when the soft ballistic shield is in a deployed configuration. First and second generally vertical supports are adapted to be coupled to the shell for providing support to the soft ballistic shield when the soft ballistic shield is in a deployed configuration. First and second generally vertical pockets for removably housing the first and second generally vertical supports are coupled to the shell. The first and second generally vertical pockets cover a majority of the first and second generally vertical supports when housing the first and second generally vertical supports in a deployed configuration. A storage pocket is oriented in a generally horizontal direction. A flap is coupled near a top of the shell and has a portion adapted to be fastened to the shell. The first and second generally vertical supports are inserted in the storage pocket oriented in a generally horizontal direction. The shell is rolled from a bottom of the shell to a top of the shell. The shell is secured in a rolled position by fastening the flap to a surface of the shell.

According to another aspect, a method of deploying a soft shield comprises the steps of providing a shell adapted to support at least one soft ballistic panel made from a soft ballistic material. At least one generally horizontal support is adapted to be coupled to the shell for providing support to the soft ballistic shield when the soft ballistic shield is in a deployed configuration. First and second generally vertical supports are adapted to be coupled to the shell for providing support to the soft ballistic shield when the soft ballistic shield is in a deployed configuration. First and second generally vertical pockets for removably housing the first and second vertical supports are coupled to the shell. The first and second generally vertical pockets cover a majority of the first and second vertical supports when housing the first and second generally vertical supports in a deployed configuration. A storage pocket is oriented in a generally horizontal direction. A flap is coupled near a top of the shell and has a portion adapted to be fastened to the shell. The first and second generally vertical supports are removed from the storage pocket oriented in a generally horizontal direction. The first and second generally vertical supports are inserted in the first and second generally vertical pockets in the deployed configuration.

According to another aspect, a method of deploying a soft shield from a rolled up storage configuration comprises the steps of unfastening a first fastener connected to a flap connected to a shell from a second fastener connected to the shell. The shell is unrolled. Vertical supports are removed from a storage pocket associated with the soft shield. The vertical supports are inserted in vertical pockets attached to the shell that are oriented in a generally vertical direction.

According to another aspect, a method of storing the soft shield that uses limited space for maintaining a soft shield in a rolled up storage configuration comprises the steps of providing vertical supports and a shell comprising vertical pockets. The vertical supports are inserted in a storage pocket oriented in a generally horizontal direction. The shell is rolled and the shell is secured in a rolled position. According to some aspects, the rolled-up shell is placed into a vehicle provided by a law enforcement agency.

Additional systems and methods of manufacturing, deploying, storing and using soft shield embodiments are also described herein and form other aspects of the present disclosure. Various features, aspects and advantages of the present disclosure can be combined with other features, aspects and advantages and such combinations are contemplated herein.

BRIEF DESCRIPTION OF THE DRAWINGS

FIGS. 16 and 17 depict features of one embodiment and includes a return-to-center mechanism.

DETAILED DESCRIPTION

Figure 1:
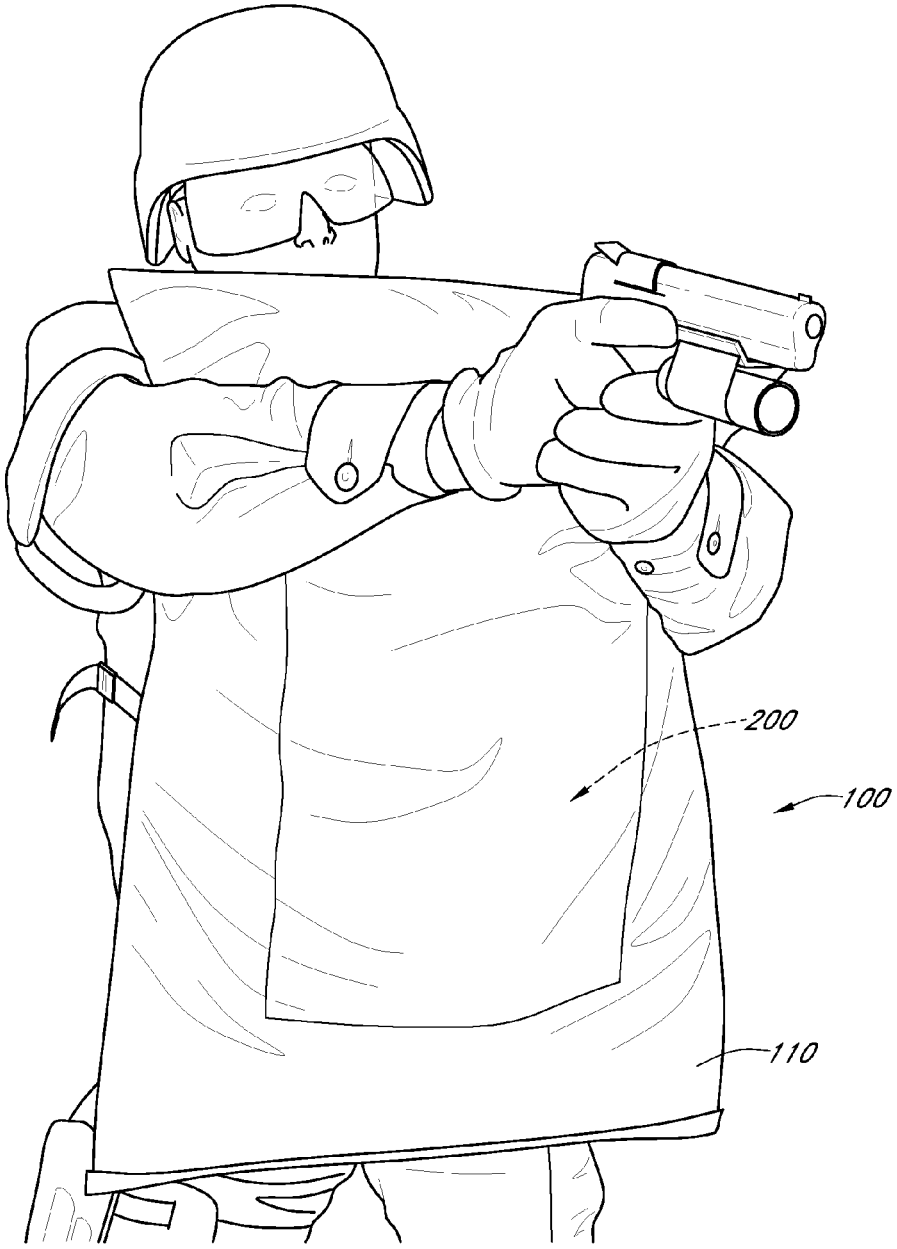
FIG. 1 shows an officer wearing a soft shield with a quick release sling for hands-free shooting.

As illustrated in FIG. 1 embodiments disclosed herein are directed to a soft shield 100 which can include a shell 110 with an identification placard 700, a sling 300 for easy carrying and hands free use and shooting ability. As shown in FIG. 1 the shell may be a rectangular shape or could be any other shape that would accommodate a human form. In an embodiment, the shell 110 may have arm indentations for easier carrier and shooting. In another embodiment, the shell 110 may be an oval shape. The shell 110 may be made of any suitable material including a 1000 CORDURA® fabric or other ballistic nylon or other suitable material. In an embodiment, the shield may be 20 inches×40 inches in size, 20 inches×28 inches in size, or any other suitable size.

Figure 14:
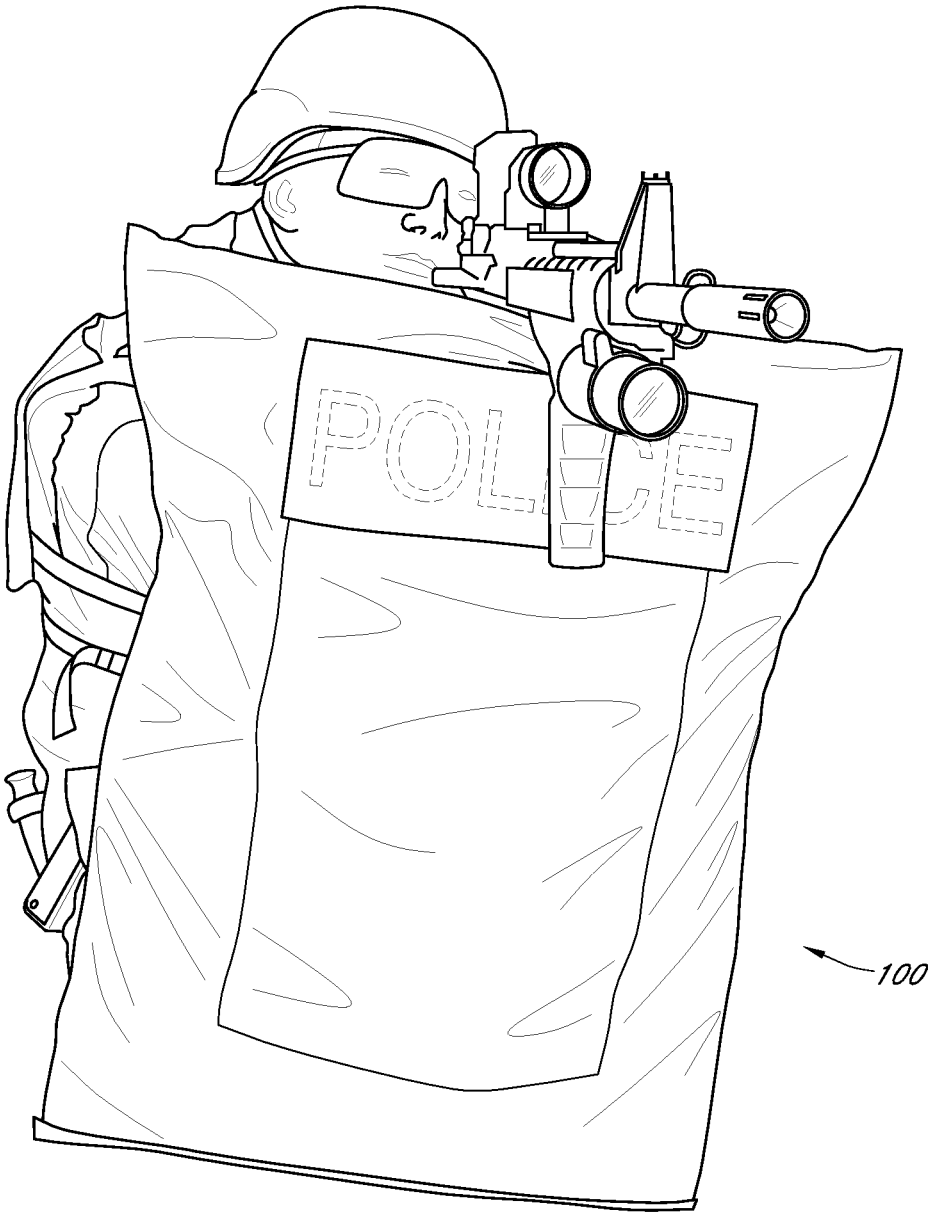
FIG. 14 shows an officer wearing a soft shield with a quick release sling for hands-free shooting of a rifle.

The soft shield 100 may be used by law enforcement professionals including Active Shooter Responders, military personnel, explosive ordinance personnel, and others to shield their body while in an active shooting situation. As shown in FIGS. 1 and 14 the shield can be fastened to the body using the sling 300 which can support the soft shield 100 hanging from the arms while the body of the soft shield 100 including the bullet resistant shell 110 covers the major body organs and vulnerable portions of the body. This however, is just one embodiment and use of the soft shield 100. Various other embodiments, positions and uses of a soft shield are possible, examples of which are disclosed herein.

In order to provide protection from projectiles, soft ballistic panels 200 may be inserted and secured inside the shell 110 of the soft shield 100. The materials in some embodiments may be the same as or similar to the materials used in concealable armor and may be subject to the same or similar NIJ testing and certification process. In some embodiments, the materials, including the soft ballistic panels 200 may be either NIJ threat level II or IIIA certified. Other certifications are also contemplated within the scope of the present disclosure. One or more ballistic panels 200 may be sealed in a water tight cover 210 to prevent the ballistic panels 200 from getting wet in a water environment. The ballistic panels 200 and the water tight cover 210 may be partially or completely housed in the shell 110. The ballistic panels 200 may be loaded into the shell 110 through the bottom of the soft shield 100 and may be secured by a flap to the shell 110. Also, the ballistic panels 200 in the soft shield 100 may be changed, allowing various ballistic packages to be used with the soft shield 100. This allows a user to select the ballistic panel 200 for a user need or preference. For example, the user may select the ballistic panel 200 based on ballistic performance or on weight, or for multi-threat the user may incorporate stab armor in addition to ballistic panels.

In an embodiment, the soft shield 100 may include one or more eyelets 500 to allow the escape of air that may be trapped during the use of the soft shield 100. The eyelets 500 may be metal or any other suitable rigid material and may be positioned at one or more corners of the soft shield 100.

In an embodiment, the soft shield 100 may be rolled up into a storage configuration for compact storing and easy carrying. A rolled up soft shield 100 may also be redeployed by unrolling the entire soft shield 100. Thereafter and in an embodiment, the soft shield's 100 support structure may be reconfigured to provide a semi-rigid frame to protect the operator from projectiles.

Figure 2:
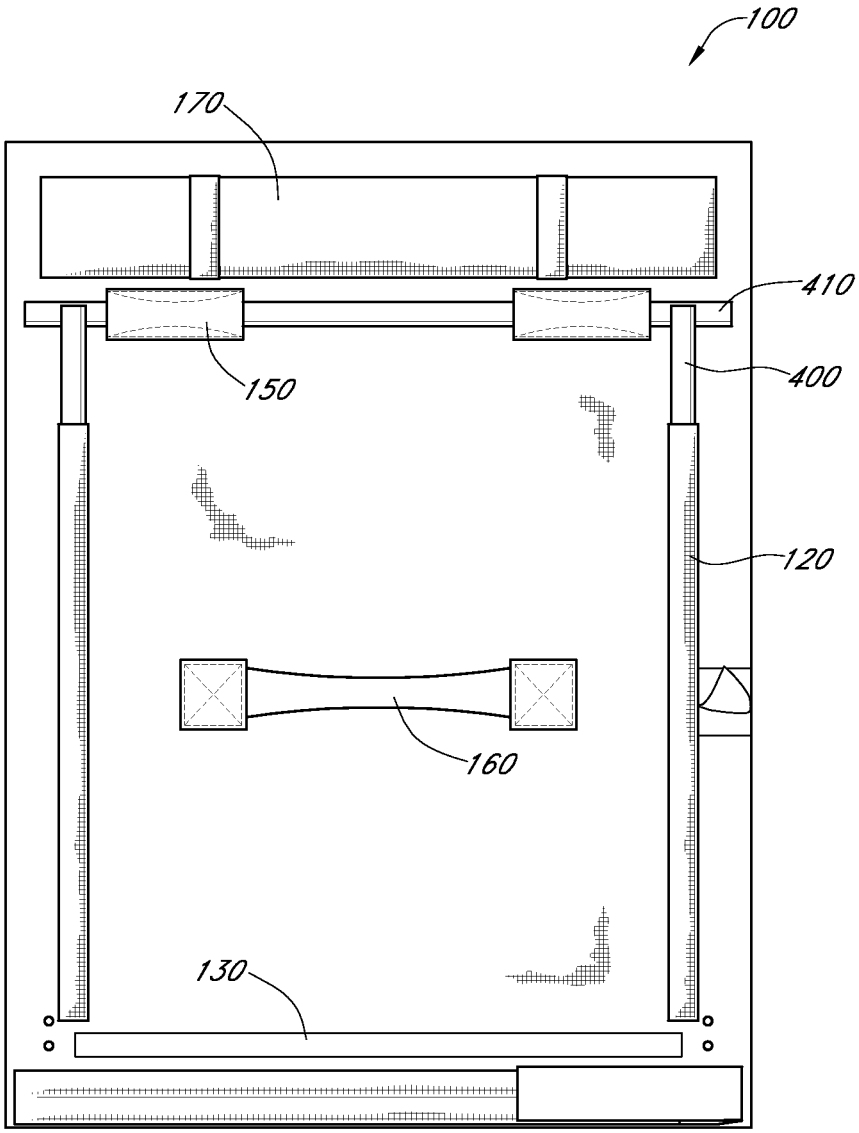
FIG. 2 shows a back side view of one embodiment of a soft shield.

FIG. 2 illustrates a back view of one embodiment of a soft shield 100. In this embodiment, there are vertical supports 400, horizontal supports 410, a handle 160, vertical pockets 120, a lower pocket 130, straps 150 and a storage pocket 135. Illustrated in FIG. 2 is the back of the shell 110 and the support frame attached to the shell 110 which includes the vertical supports 400 and the horizontal supports 410.

In an embodiment, the vertical supports 400 and the horizontal supports 410 may be comprised of any suitable material and may be any suitable shape in order to provide a rigid frame and support structure for the soft shield 100 while it is deployed and in use by law enforcement personal. In an embodiment, the supports 400, and 410 may be made from hollow PVC pipe, nylon with embedded glass, other plastics, steel, or other suitable materials. The supports 400 and 410 may be hollow, solid or somewhat flexible. Further, the supports 400, and 410 may be rod shaped, an elongate rectangle, an elongate hexagon or other configurations. The supports 400 and 410 may be telescoping or any other suitable configuration or material that provides a semi-rigid frame for the fabric shell 110. There may be circumstances in which it may be advantageous to remove one or more of the vertical supports 400 and/or the horizontal supports 410 while the soft shield 100 is in use. Such as, for example, during use in a confined area such as a tunnel or while traveling through a narrow space. The supports 400 and 410 may be quickly removed and replaced to facilitate use of the soft shield in some embodiments and uses.

In one embodiment, vertical pockets 120 are pockets that run vertically near the edge of the shell 110 on either side of the shell 110. In an embodiment, vertical pockets 120 may have an opening near the top of the vertical pocket 120 that allows the vertical support 400 to be inserted in the vertical pocket 120 to provide a frame for the shell 110. In one embodiment, the vertical pocket 120 covers the majority of a vertical support 400 that is inserted into the vertical pocket 120. In another embodiment, the vertical pocket 120 covers nearly half of vertical support 400 when inserted in the vertical pocket 120. The vertical pockets 120 may be made of any suitable material including a CORDURA® or other ballistic material, nylon or other tough fabric to absorb energy. In an embodiment, vertical pockets 120 are sewn onto the shell 110. In an embodiment, the vertical pockets 120 may be on a slight angle to the vertical either angled towards a vertical center line on the shell 110 or away from the center line on the shell 110. In an embodiment, the vertical pockets 120 may be a continuous pocket of material. In another embodiment, the vertical pockets 120 may be made of a series of closely spaced straps with openings in between the straps. In another embodiment the vertical pockets 120 may be a combination of a pocket that covers half or a portion of the vertical supports 400 and a single or multiple straps attached to the other part of the vertical supports 400. In an embodiment, the vertical pockets 120 may be any combination of straps, pockets supports or other components known in the art that may securely attach the vertical supports 400 to the shell 110 in a secure and safe manner.

In an embodiment, the top three inches of the vertical pockets 120 may be wider to make entry of the vertical supports 400 easier. In an embodiment, the vertical pockets 120 may be on the inside or the outside of a sectional strap 165 near an outer perimeter of the soft shield 100. In one embodiment, the vertical pockets 120 run along the outside edge of the shell 110. In one embodiment, the vertical pockets 120 have an opening near the top of the vertical pockets 120. In another embodiment, the vertical pockets 120 have an opening near the bottom of the vertical pockets 120.

The vertical pockets 120 provide increased contact and support to the vertical supports 400 and thereby increase the amount of support to the shell 110 while the support structure is in place. This allows the soft shield 100 to have sufficient support to avoid collapse during the impact of a projectile.

In an embodiment straps 150 may be used to fasten a horizontal support 410 to a top portion of shell 110. The straps 150 may be relatively wide or relatively thin and in an embodiment, wrap around a horizontal support 410 and fasten to a VELCRO® or other fastening means on the straps 150 and/or on the shell 110. Straps 150 may be made of any suitable material including CORDURA® or other ballistic material, nylon, any elastic material or other tough material to absorb energy. In an embodiment, the straps 150 may be a pocket. Straps 150 may be sewn on or attached and manufactured in any other suitable manner known in the art.

Figure 16:
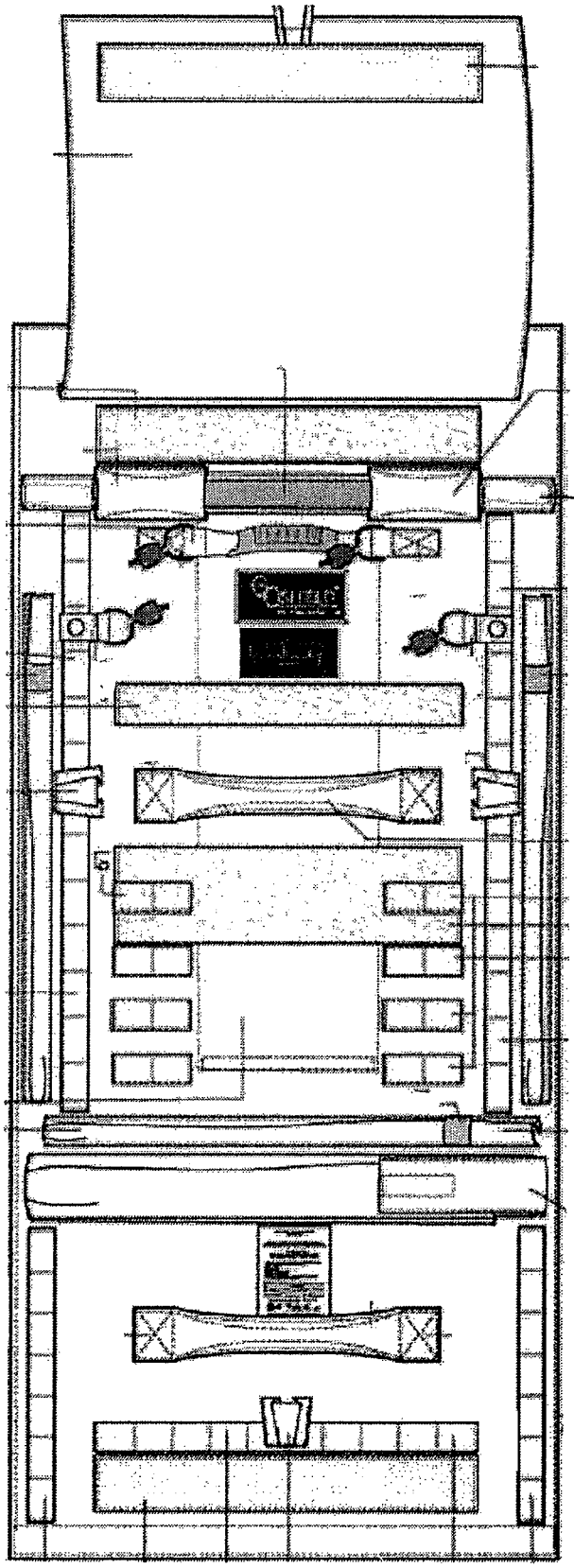
FIG. 16 shows a back view of another embodiment of a soft shield having rod retainer caps.
Figure 17:
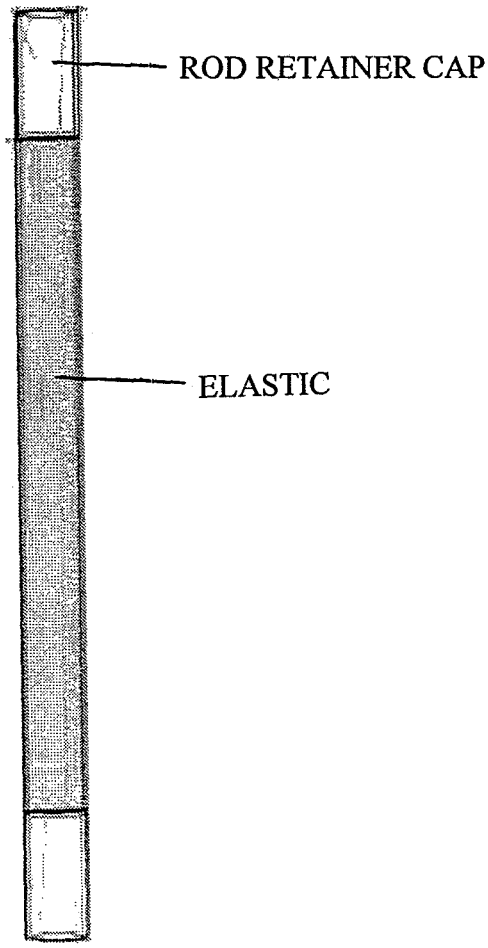
FIG. 17 is a detailed view of the rod retainer caps of FIG. 17 and shows an elastic band for coupling the rod retainer caps to the soft shield.

As shown, for example in FIGS. 16 and 17, in some embodiments, the soft shield 100 may contain a rod centering mechanism coupled to the straps 150 that hold the horizontal support 410 to the top portion of shell 110. The rod centering mechanism in one embodiment comprises end caps. End caps are preferably configured such that the end caps may be placed over the ends of the upper horizontal support 410 to hold the support in position. The caps can be made of 1000 Cordura or other suitable material known in the art and may have elastic, or other suitable material, sewn to the back of the caps. In some embodiments, the elastic may run entire length of the rod and may be sewn to the outside of the outer carrier. In some embodiments, elastic may only run part of the way or may be connected to a part of the soft shield 100 in order to put a centering force on the horizontal support. In other embodiments other flexible materials may be used to provide a centering force. The ends of the elastic are not sewn to allow the elastic to stretch and return to its starting place. With both ends capped and attached to the elastic, the effect is that when the user of the soft shield 100 shoots hands free, or does any other movement that makes the soft shield 100 compress and contract, he is able to compress the shield with both arms to get his arms around it and take a two-handed shooting position. When this occurs, the elastic stretches and then returns thereby keeping the upper rod in its place so it does not eject itself from the elastic bands that support it. The elastic helps the soft shield return to its neutral position when not being used.

In an embodiment, a lower pocket 130 is attached to the shell 110 in order to provide a space for a horizontal support 410 to be inserted. In some embodiments, the lower pocket 130 may fully cover a horizontal support 410. In other embodiments, the lower pocket 130 may only partially cover the horizontal support 410, may be a series of straps, and may be angled slightly from the horizontal. The lower pocket 130 may be made of any suitable material including CORDURA® or other ballistic material, nylon or other tough fabric to absorb energy.

The storage pocket 135 may be a horizontal pocket in which the vertical supports 400 may be stored in while the soft shield 100 is in the storage configuration. In some embodiments, the storage pocket 135 may be near the bottom of the soft shield 100 on the back side. In other embodiments, storage pocket 135 may be horizontal oriented, or nearly horizontal in any convenient place on the front or back side of the shell. The storage pocket 135 may be sewn on or any other suitable method of manufacturing known in the art. The storage pocket 135 may be made of any suitable material including CORDURA® or other ballistic material, nylon or other tough fabric to absorb energy.

In an embodiment, a handle 160 may be attached to the shell 110 in order to provide a law enforcement office or other user a means to hold the soft shield 100. In an embodiment, the handle 160 is positioned on the back side of the shell 110 and near the middle of the shell 110 to provide a center balanced location for an officer to grip and balance the soft shield 100 while deployed. In an embodiment, the handle 160 may be horizontal or slightly angled from the horizontal. In another embodiment, the handle 160 may be attached via snaps and may be positioned in a variety of positions depending on the need. In an embodiment, the handle 160 may be made of any suitable material including CORDURA® or other ballistic material, nylon or other tough fabric to absorb energy and provide durability from extended carrying of the shell 110 by the handle 160. The handle 160 may be attached by any suitable means including sewing or other methods known in the art.

In an embodiment, the soft shield 100 may include a front side plate pocket 600 to hold a hard armor plate 610 that may stop larger rounds, such as rifle rounds. In some embodiments, the hard plates 610 can be positioned at other locations on the soft shield 100. The front side plate pocket 600 may be designed to hold a 10 inches×12 inches or any other size armor plate 620. In an embodiment, the front side plate pocket may also be sewn to the shell 110.

In an embodiment, the soft shield 100 may be rolled up into a storage configuration for compact storing and easy carrying. In an embodiment, first two vertical supports 400 are preferably removed from the vertical pockets 120 and placed in the storage pocket 135. Next, in an embodiment, the bottom of the soft shield 100 may be first rolled all the way until the top of the soft shield 100, and the flap 170 may be the last portion to roll, allowing the fastener 180 on the flap to be attached to another fastener 180 on the rolled up shield 100 to secure the soft shield 100 in the rolled up configuration. A rolled up soft shield 100 may also be redeployed by unfastening the flap 170 and unrolling the entire soft shield 100. Thereafter and in an embodiment, the vertical supports 400 may be removed from the storage pocket 135 and placed in the vertical pockets 120 in order to reconfigure the support structure.

Figure 3:
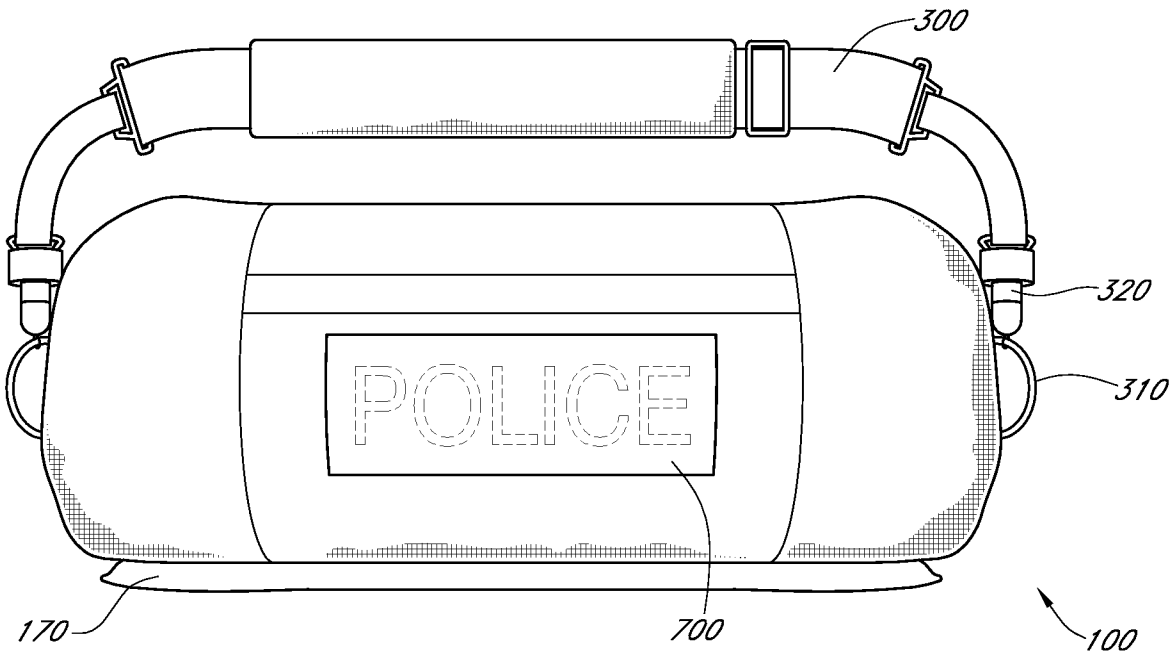
FIG. 3 shows another embodiment of a soft shield rolled up in a storage position.

FIG. 3 illustrates another embodiment of a soft shield 100, rolled up and stored with flap 170 securing the soft shield 100 in a rolled up position using a fastener 180 such as VELCRO® or other suitable materials known in the art. Also illustrated is a carrying system for the soft shield 100 with rings 310, sling 300, and quick release 320, along with identification placard 700. This makes for a convenient storing and carrying configuration providing added convenience and space saving advantages to the soft shield 100 when it is not in use. The soft shield 100 may be rolled up and stored in its own bag. But it may also store itself, for example by securing the rolled up soft shield 100 with the flap 170 at the top of the soft shield 100 (e.g., the flap 170 may be fastened to the rolled up soft shield 100). This may allow the soft shield 100 to be carried, slung over the shoulder or suspended to things like the underside of a table or desk. The soft shield 100 may be hung from metal brackets as well. A rolled up soft shield 100 may facilitate carrying of the soft shield 100 by the Coast Guard when boarding small boats, by SEAL teams when climbing caving ladders to board large ships or oil rigs, or by an officer who is responding to a call and needs to walk a distance. The soft shield 100 can be placed in a water tight bag that may allow for positive buoyancy so that a waterborne approach and insertion can be made without getting the shell 110 wet. The rolled up soft shield 100 may also disguise the shield from onlookers. The shield may include a tab 185 that may be located along the edge and at the center of the soft shield 100 to allow for a positive grip for quick deployment (for example, unrolling a rolled shield).

The soft shield 100 may include a flap 170 located at the top of the soft shield 100 to enable the soft shield 100 to be hung from car doors, boat rails, etc. The flap 170 may be wrapped around the object and attached to itself or the soft shield 100, for example by hook-and-loop fasteners 180 such as VELCRO®. The flap 170 may roll and secure itself with the fasteners 180. Other fasteners 180 may be used, including buckles, loops, buttons, zippers, clips, etc. In an embodiment, the flaps 170 may be attached to the top, the bottom, or the sides of the soft shield 100, to enable the soft shield 100 to be attached to other objects, for example car doors, boat rails, railings, window frames, etc. The flap 170 may loop over the other object and attach to itself or another part of the soft shield 100. The flap 170 may be rolled up and may secure itself with fasteners 180. A flap 170, such as the flap 170 at the top of the soft shield 100, can either be rolled and secured, or be secured unrolled to the front of the soft shield 100. This may allow for quick securing of the flap 170 when deploying the shield by simply smoothing the flap 170 by hand. There may not be time to roll it.

Figure 4:
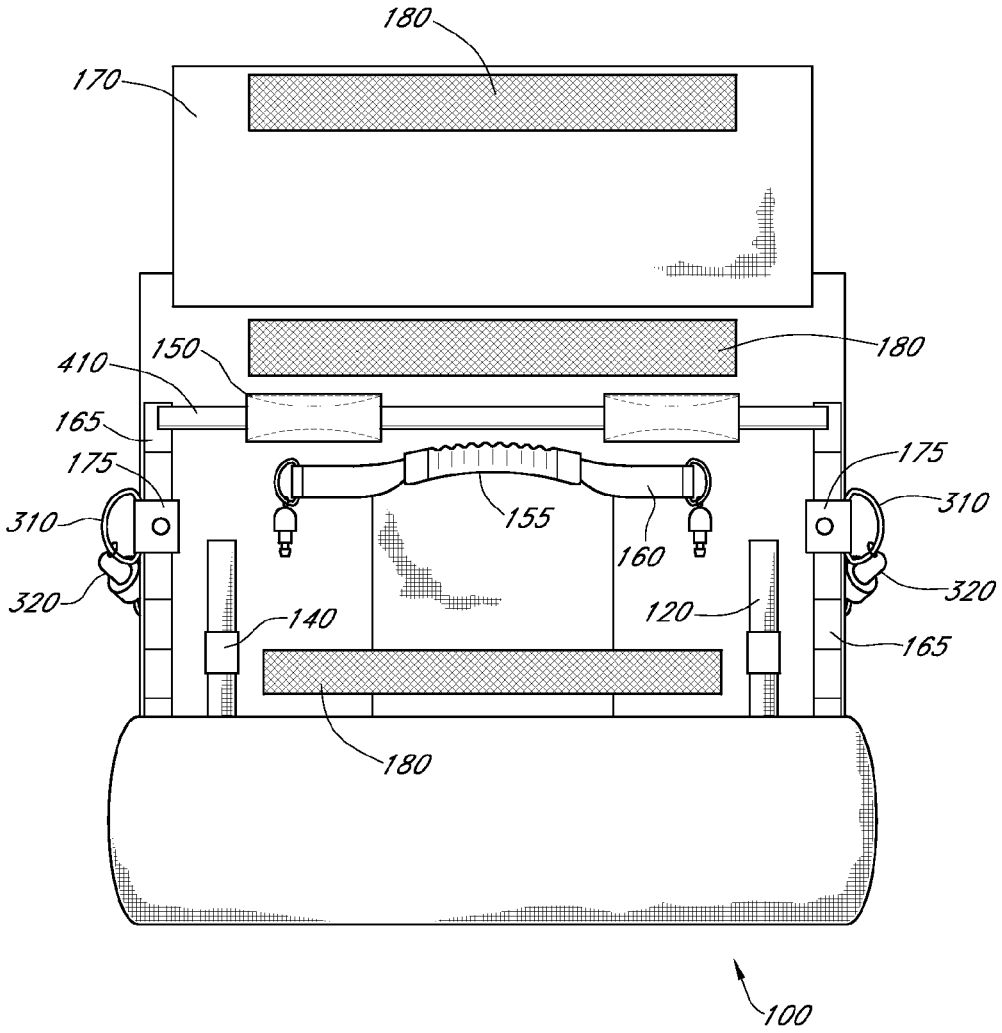
FIG. 4 shows the soft shield of FIG. 3 being partially unrolled in order to be deployed.

FIG. 4 illustrates the soft shield 100 being unrolled from the rolled position shown in FIG. 3. Illustrated is the flap 170 in an open position with fasteners 180 being unfastened before the soft shield 100 is unrolled. In this embodiment, the vertical supports 400 are being stored in the storage pocket 135. In an embodiment, once the soft shield 100 is completely deployed, the vertical supports can be inserted into the vertical pockets 120. Also illustrated in FIG. 4 is an embodiment with an additional handle 160 with grip 155. In an embodiment, the grip 155 may be attached to handle 160 for improved comfort and gripping ability. The grip 155 may be made from any suitable material in the art including rubber, or other non slip materials. In an embodiment, the grip 155 may have grooves for fingers. In an embodiment, the additional handle 160 with the grip 155 may be placed higher than the other handle 160 or in any other convenient place to provide ergonomic and efficient handling of the soft shield 100 by a user.

The soft shield 100 may also include sectional straps 165, for example a MOLLE or a Pouch Attachment Ladder System. The sectional straps 165 may be sections of strap that are formed in a substantially straight line and that are sewn across at intervals, for example every 1.75 inches. Pouches with straps that feed through the sectional straps 165 may be coupled to the sectional strapping 165. In an embodiment, the soft shield 100 may have sectional straps 165 attached in a variety of places on the back or front side of the shell 110. In an embodiment, the sectional straps 165 provide a substrate to attach snap on connectors 175. The snap on connectors 175, in an embodiment, are attached to rings 310 or other connecting devices known in the art. The rings 310 may be attached to the quick release connectors 320. The quick release connections 320 may also connect to the sling 300 thus, the sectional straps 165 allow the sling 300 to be attached at a variety of connection points originating from a variety of places on the shell 110 to allow extreme versatility of the manner and orientation in which the soft shield 100 may be worn or carried to accommodate a variety of foreseen or unforeseen circumstances in a hostile shooter situation. In an embodiment, the sectional straps 165 may be attached to the sides of the shell 110 to allow the sling 300 to connect from one side to the other side of the shell 110.

The sectional straps 165 may be positioned at one or more of the outer edges of the soft shield 100, such as the back side of the soft shield 100. The section straps 165 may also be placed inward of the vertical pockets 120. The snap-on connectors 175 that are coupled to the rings 310 may be removably coupled to the sectional straps 165, allowing a user to adjust the location of the rings 310. The adjustable position of the rings 310 may allow for adjustment of the sling 300 attachment points, allowing a user to raise or lower the height of the soft shield 100 when they are supporting the soft shield 100 with the sling 300. This allows the user to adjust the shield into a position which provides correct coverage of about chin to knee and also for correct positioning for shooting with a pistol. A user can thus directly engage an enemy in proper shooting position without the shield interfering. Otherwise, without adjustability, the shield may be too low which would require the shooter to come underneath the horizontal support 410 and lift the soft shield 100 to allow for a two handed shooting position.

The adjustable position of the rings 310 also allows for additional rings 310 to be attached at other points, and an additional sling 300 may be attached to allow the soft shield 100 to be used as a medical litter or as a backpack with two slings 300 or a single sling 300. Anything that may be coupled to the sectional straps 165 may be coupled to the soft shield 100. This may also allow the soft shield 100 to be coupled to a patrol vehicle's light bar or allow the soft shield 100 to be suspended in front of the windshield or a window, among other uses. Additional sectional straps 165 may be included on the front part of the soft shield 165 to allow for the same fastening options in the soft shield's 100 folded position as in the extended position.

In an embodiment, the quick release connection 320 may be a metal "snap latch" that is spring loaded to allow for positive attachment and disconnect or any other form of quick release known in the art. The pull tab on the quick release connection 320 may be attached to a small metal ring 310 and then attached to the metal device, and it may be pulled to allow the spring loaded device to release. In another embodiment, the quick release connection 320 may be a plastic weapons type device with a male and female end that secure together and that are releasable by the soft shield 100 user.

In an embodiment, the sling 300 is an adjustable sling 300 that may be coupled to the soft shield 100 to enable hands free use. The sling 300 may include another buckle to allow for adjustment of the sling 300. Adjustment of the sling 300 may enable the user to transition from shorter to longer lengths for weapons use, or vice versa. In an embodiment, the sling 300 may include a webbing strap that is fed through plastic reducers. The reducers may allow for the transition from a larger strap to a smaller one that attaches to the quick release connection 320. The sling strap may include padding wrap to allow for more comfortable wear.

In some embodiments, the soft shield 100 may also be folded into shorter lengths. For example, a top portion, a side portion, or a bottom portion may be folded in or out to adjust the dimensions of the soft shield 100. The pockets that hold the one or more supports may be positioned accordingly. Multiple supports may be used along an axis to allow the shield to be folded or unfolded along the axis while the supports are in place.

The fasteners 180 may be positioned on the soft shield 100 to hold the folded shield 100 in the folded position. For example, fasteners 180 may be attached to the shield above and below the lower handle 160 to allow the lower part of the shield to be secured in a folded position. This provides the ability to keep the soft shield 100 in a shorter configuration for use in situations that involve more confined spaces, such as tunnels, crawl spaces, buses, and airplanes. In take down situations, the soft shield 100 may be deployed in the shorter configuration and positioned in between the vehicle door and the seat without obstructing the window area. When the officers exit the vehicle the shield may be quickly brought into action. The soft shield 100 may then be further deployed to the full 20 inches×40 inches by accessing the pull tab that may be located at the bottom of the soft shield 100.

Figure 5:
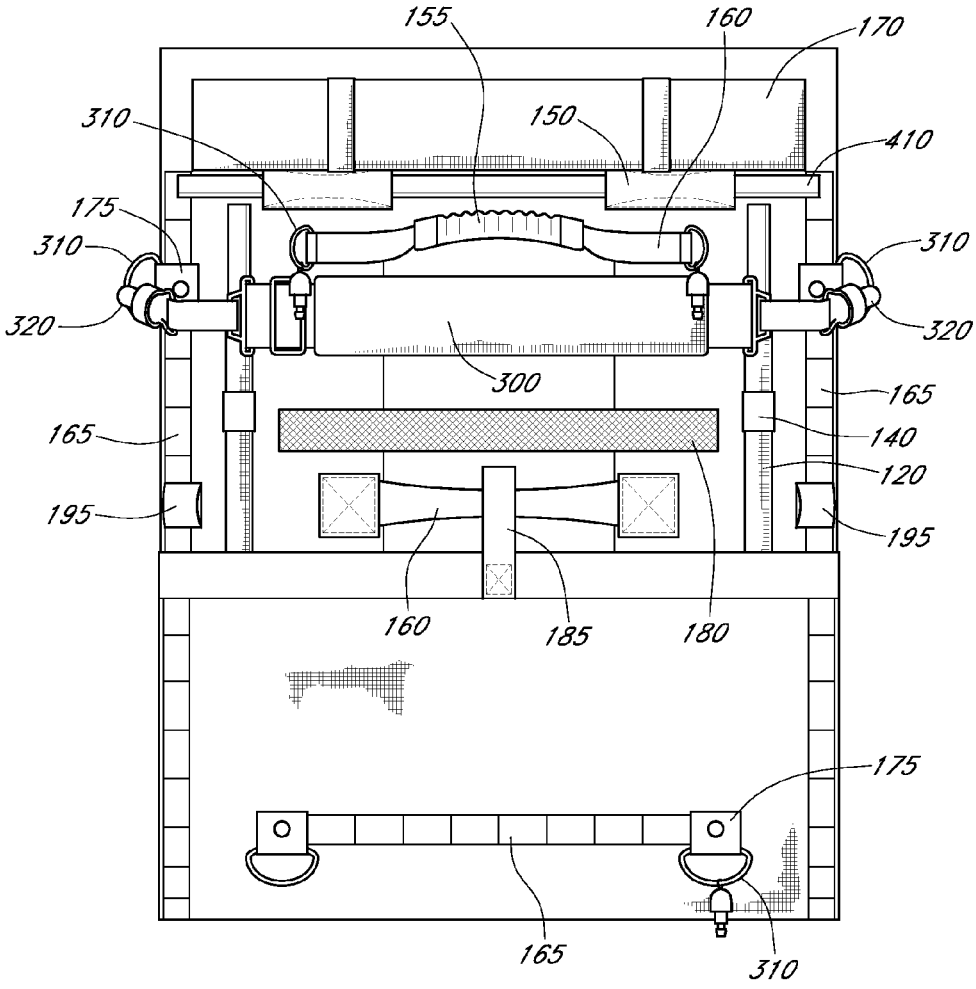
FIG. 5 shows a back view of the soft shield of FIG. 3 with a bottom portion folded and fastened to decrease the size of the shield in a shortened deployed configuration.

FIG. 5 illustrates a configuration of the soft shield 100 in which the bottom portion of the shell 110 has been folded up and fastened with fasteners 180 in order to decrease the length of the shell 110 and the overall shield length for certain uses of the soft shield 100 in which a smaller soft shield 100 may be advantageous. For example, a shorter officer might find the longer soft shield 100 cumbersome and therefore folding the shield may provide a more ideal size. Also illustrated is sectional strapping 165 on the front of the soft shield 100 with the snap on connector 175, rings 310, the quick release connection 320 to attach sling 300. Also illustrated is a tab 185 to provide easy unfolding and unfastening of a folded soft shield 100. In an embodiment, the soft shield 100 may have a small pocket 195 that will provide a small opening for a broomstick handle or other elongate handle that can be inserted into small pocket 195. The small pocket 195, in an embodiment, can then support the entire soft shield 100 from an elongate rod or handle inserted into the small pocket 195. This will allow an operator to hold the soft shield 100 in front of other officers, or in front of a window, or from a ladder, in certain situations where holding the soft shield 100 by the handles will not provide adequate protection.

Figure 6:
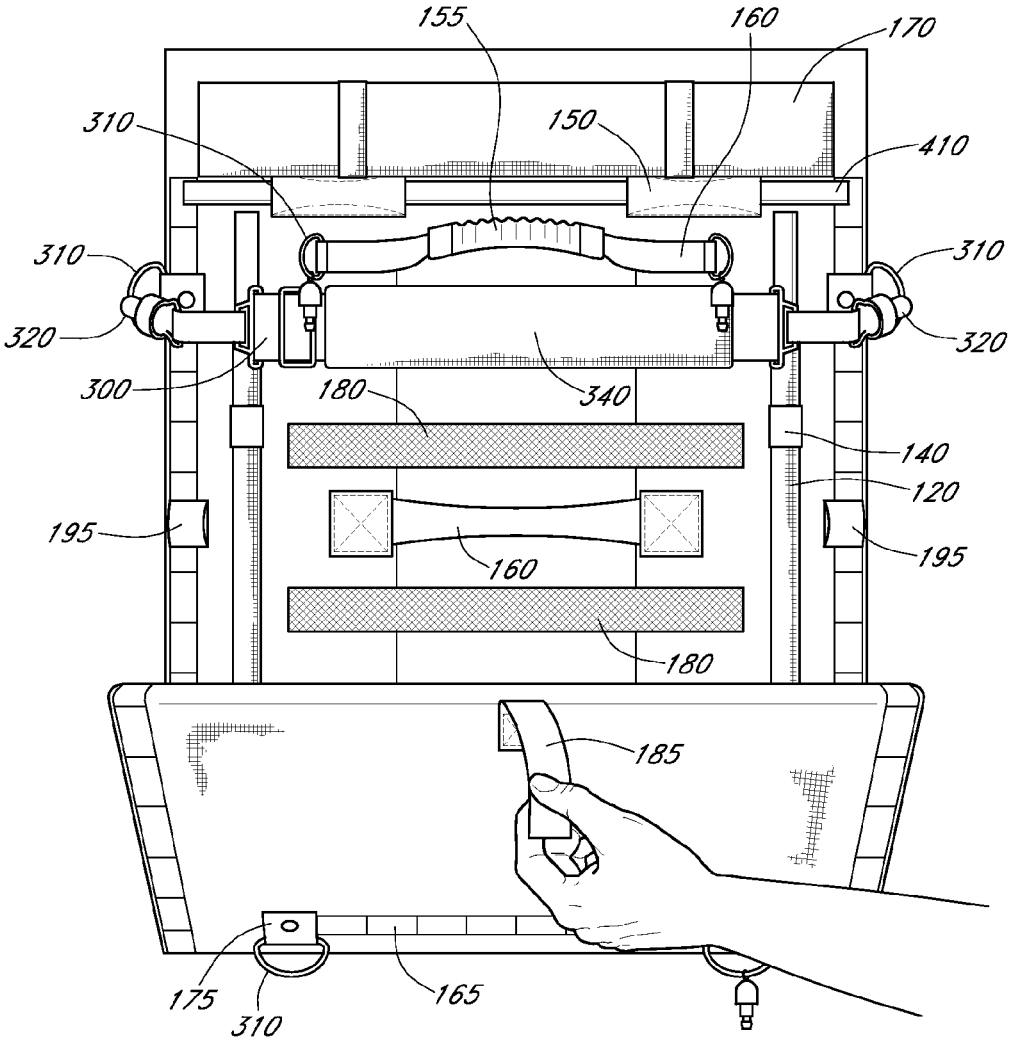
FIG. 6 shows a perspective view of the soft shield of FIG. 3 being unfolded and unfastened into a full size deployed configuration.

FIG. 6 illustrates an embodiment of the soft shield 100 while an operator is unfolding the bottom portion of the soft shield 100 from the folded position of FIG. 5 in order to unfold the soft shield 100 back to its full length deployed state. In this embodiment, fasteners 180 are illustrated that are used to attach the bottom half of the shell 110 to the middle of the shell 110 in order to fold the soft shield 100. In this embodiment, the operator is pulling on tab 185 in order to fully deploy the soft shield 100. The tab 185 can be made from CORDURA® or any other material and made into a small flap or piece of material for convenient grasping and pulling. Also illustrated is a flap 170 in a rolled position so as not to interfere with an officer's use of the soft shield 100 while in an active hostile shooter situation.

FIG. 6 illustrates configuring the soft shield 100 from the folded configuration to the full length configuration. FIG. 6 illustrates an embodiment of the vertical pockets 120 in which the bands 140 may be attached around the circumference of the vertical pockets 120 in order to provide increased stability and support for the vertical supports 400 when they are inserted into the vertical pockets 120. The bands 140 may be elastic so as to provide increased pressure on the vertical supports 400 when they are inserted into the vertical pockets 120.

Figure 7:
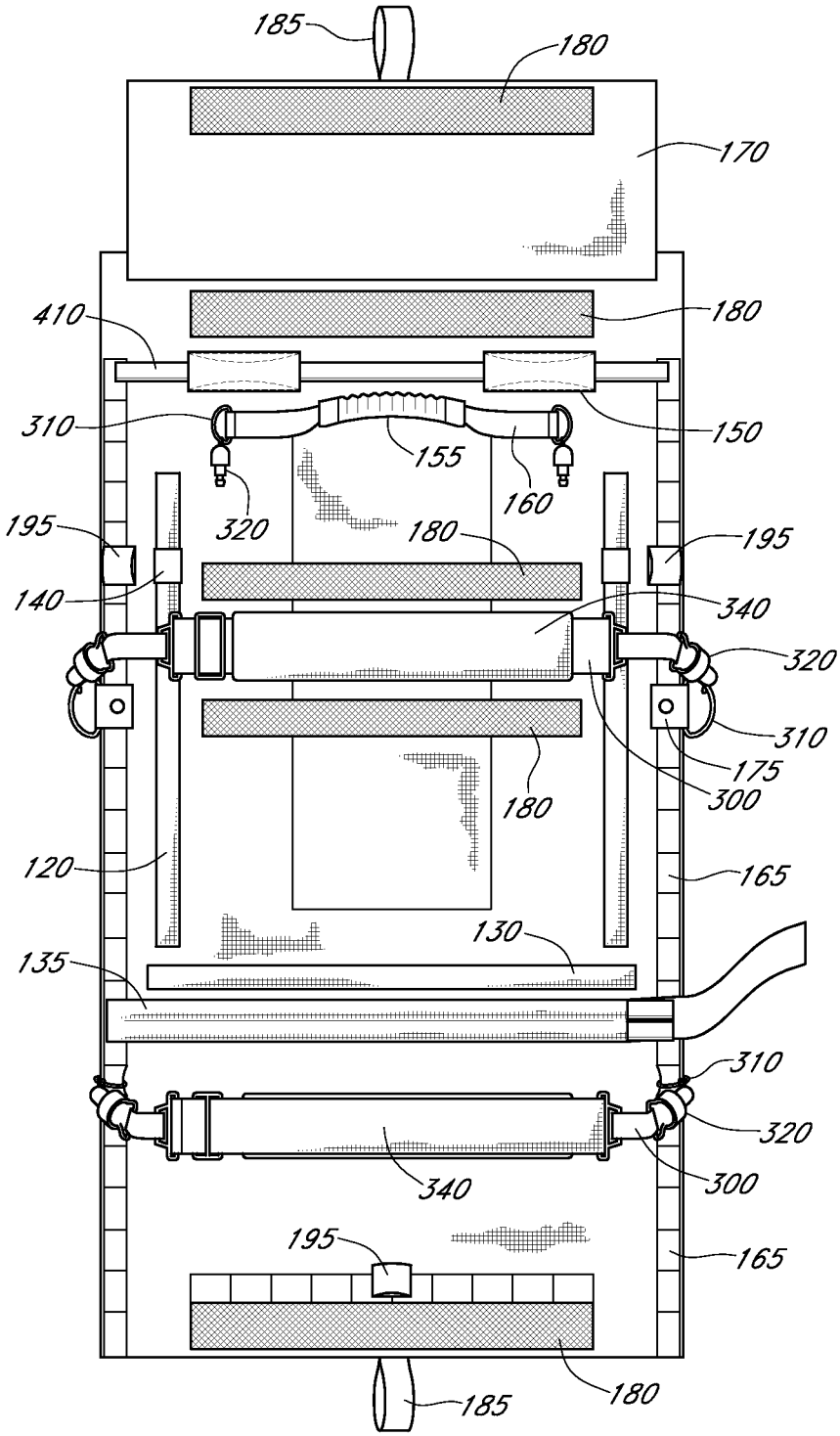
FIG. 7 shows a back view of the soft shield of FIG. 3 in the fully deployed configuration with a flap extended.

FIG. 7 illustrates a completely unfolded and deployed soft shield 100. In this embodiment the flap 170 is completely unrolled, and an upper fastener 180 is illustrated that the flap 170 may connect to in order to hang the soft shield 170 from an object or in order to roll up flap 170 and keep the flap 170 in a secure and non-interfering position.

FIG. 7 illustrates a back view of one embodiment of a soft shield 100. In this embodiment, there are vertical supports 400, horizontal supports 410, a handle 160, vertical pockets 120, a lower pocket 130, straps 150 and a storage pocket 135, similar to those described with reference to FIG. 2.

One or more additional back face pads may also be placed on the soft shield 100, such as near the contact points of the hand or the arm on the soft shield 100, to provide extra cushioning for the user when the soft shield 100 is worn and struck by an object. FIG. 7 shows the position of an interior pocket 190 that can be used to secure the face pad.

In an embodiment, fasteners 180 may be positioned on either side of the lower handle 160 in order to allow the lower portion of the shell 110 to be folded up and fastened to fasteners 180 so that the shell 110 may be decreased in length. In an embodiment, sectional straps 165 may be attached to the sides of the shell 110 to provide a convenient place to attach the snap on connectors 175 so that the rings 310 may provide a place for the quick release connection 320 to connect to the sling 300. The sling 300 may then be wrapped around the body to allow hands free use of the soft shield 100 so that the free hands may be used to operate a weapon. Also shown in this configuration is the position of the storage pocket 135 that provides a place to store vertical supports 400 while the vertical supports 400 are not in use and the soft shield 100 is in the rolled position.

Figure 8:
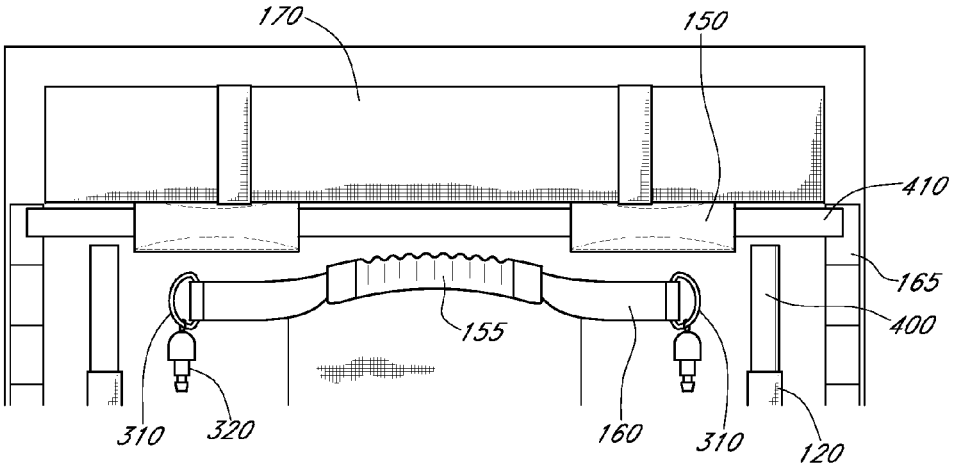
FIG. 8 shows a back view of the soft shield of FIG. 3 with the upper flap rolled up.

FIG. 8 illustrates a detailed view of an embodiment of the upper portion of the soft shield 100 including the rolled upper flap 170, the horizontal supports 410, the vertical supports 400, the straps 150 for strapping the horizontal supports 410, and the upper handle 160 with the grip 155. In this embodiment the straps 150 are wrapped around the horizontal supports 410, to hold the horizontal supports 410 in place. The straps 150 can be rolled from below the horizontal supports 410 or above, and may be fastened to the shell 100 or to another part of the straps with any suitable connection known in the art such as VELCRO® so that the straps may be easily attached and undone and reattached for multiple uses. In an embodiment, the straps 150 may be permanently sewed to the shell 110 and the horizontal support may be slide through the straps 150 from the side to be secured in place. In another embodiment, the straps 150 may be a full length pocket that permanently encloses the upper horizontal support 410.

Figure 9:
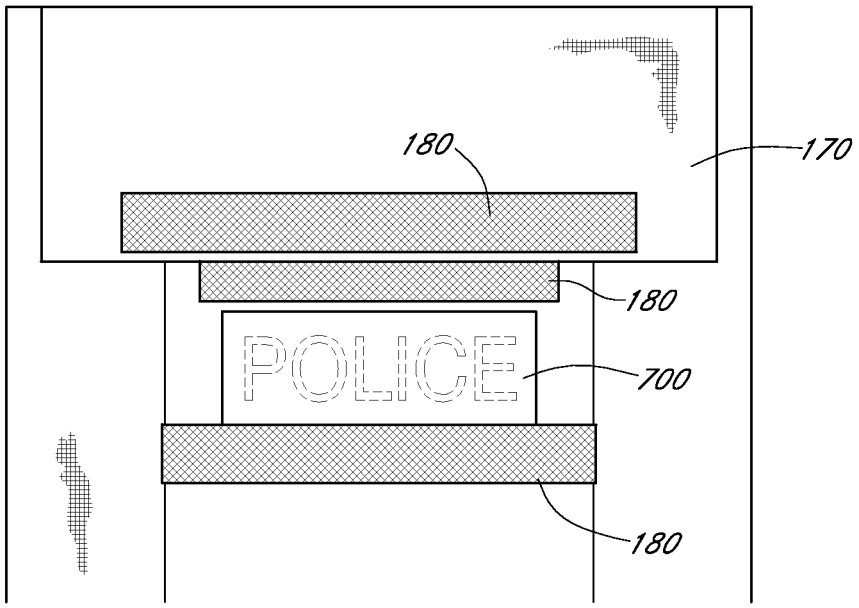
FIG. 9 shows a front view of the soft shield of FIG. 3 with the flap secured to the front side of the shield.

FIG. 9 illustrates a detailed front view of the soft shield 100 with identification placard 700 in the middle of the soft shield 100 to enhance coordination of attacks and to provide psychological intimidation to a potential hostile shooter. The identification placard 700 may be attached by a hook-and-loop fastener 180, adhesive, or other suitable connections known in the art. In this embodiment, the fasteners 180 may be attached to the front of the soft shield 100 so that the flap 170 may be folded down and secured in place either while hanging the soft shield 100 in a storage position or to keep the flap 170 out of the way during use. When the flap 170 is being used to hang the soft shield 100, the flap 170 may be wrapped around a pole or other structure and then the fasteners 180 on the flap 170 and the shell 110 or other parts of the flap 170 may be used to fasten the flap 170 securely around the structure from which the soft shield 100 is hanging.

Figure 10:
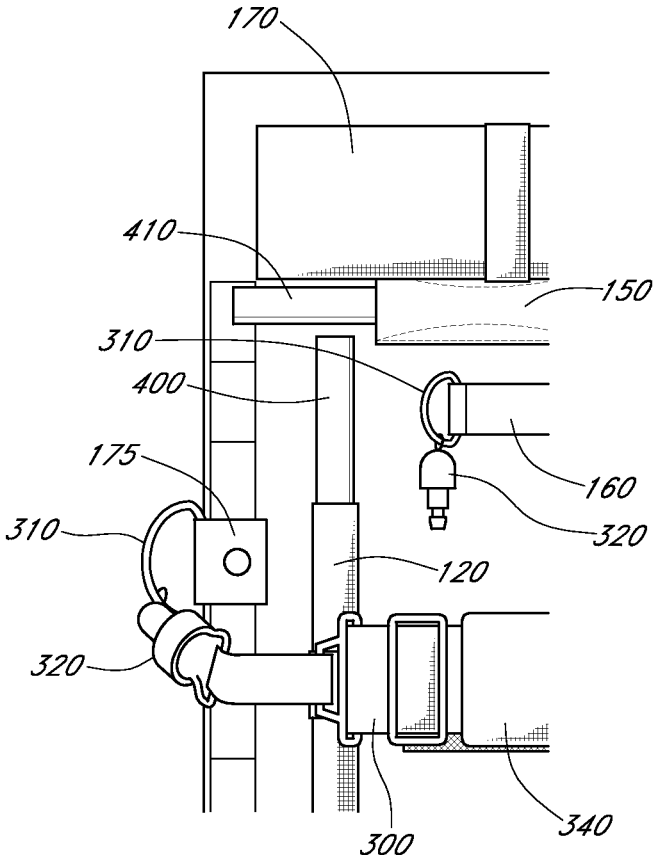
FIG. 10 shows a detailed back view of the sectional strapping and clip on fasteners and quick release connection attached to the sling of the soft shield of FIG. 3.

FIG. 10 illustrates a detailed view of an embodiment of the corner of the support frame and its interaction with the shell 110 and the vertical pocket 120 and the straps 150. In this embodiment, the support rods are not secured at the corners and not secured to each other. This provides increased flexibility of the soft shield 100 while in use, while still maintaining a rigid structure that provides adequate protection from projectiles for an officer. In another embodiment, the vertical supports 400 and the horizontal supports 410 may be joined at the corners to provide an even more rigid frame. In another embodiment, the corners of both the horizontal supports 410 and the vertical supports 400 may be secured to the shell 110 but not to each other.

Also illustrated in FIG. 10 is a detailed view of the sectional strapping 165 and the snap on connector 175 that contains the rings 310. The rings 310 may be connected to the quick release connection 320 or other suitable connection known in the art to attach to the sling 300.

Figure 11:
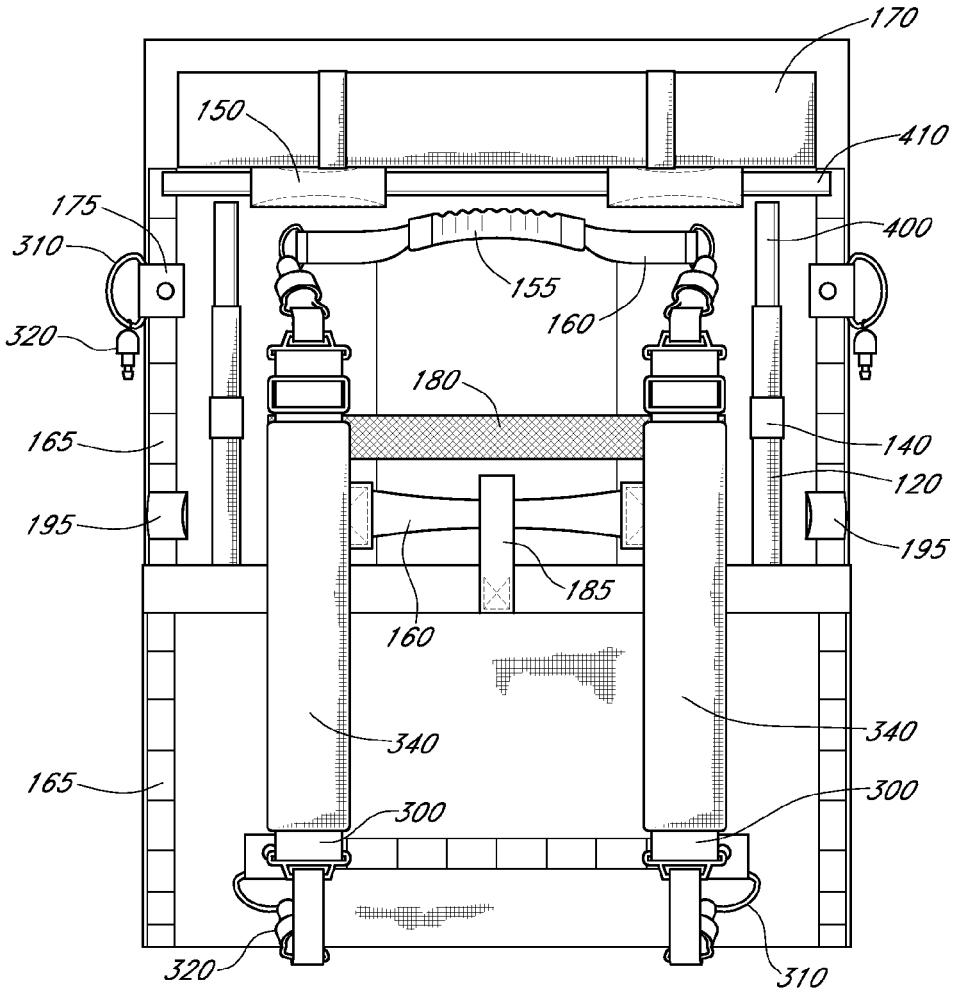
FIG. 11 shows a back view of the soft shield of FIG. 3 with a bottom portion of the shield folded and fastened and two slings attached to the shield for backpack style carry.

In other embodiments, the sectional straps 165 and sling 300 system may be utilized in a variety of different configurations to provide different functionality and carrying options for different applications in the field. In one embodiment and as illustrated in FIG. 11, the soft shield 100 may be configured into a back-pack style shield for easy carrying and protection of the back, for example in a possible retreat or in a situation where the soft shield 100 may be worn as a backpack and a second soft shield may be carried by the user to protect the officer's front side. In this embodiment, the bottom portion of the soft shield 100 is folded and attached by the fasteners 180 in order to decrease its size.

In this embodiment, the rings 310 may be attached to the upper handle 160 which are in turn attached to the quick release connection 320. From each of the quick release connections 320, one side of a sling 300 is attached while the other side is attached to rings 310 that are attached to sectional strapping 165 on the front side of the shell 110 below the rings 310 that are attached to the upper handle 160. As the shell 110 is in a folded configuration, the sectional straps 165, and rings 310 are now facing towards the back and are available to be attached to the sling. The rings 310 on the sectional straps 165 for connecting the lower half of the sling 300 may be directly below or slightly offset to the right or left from the rings 310 and connections to the upper handle 160 to provide straps that are vertically or nearly vertically oriented. This will allow the slings 300 to have a back-pack style configuration so that they can be easily slung over the shoulder.

Figure 12:
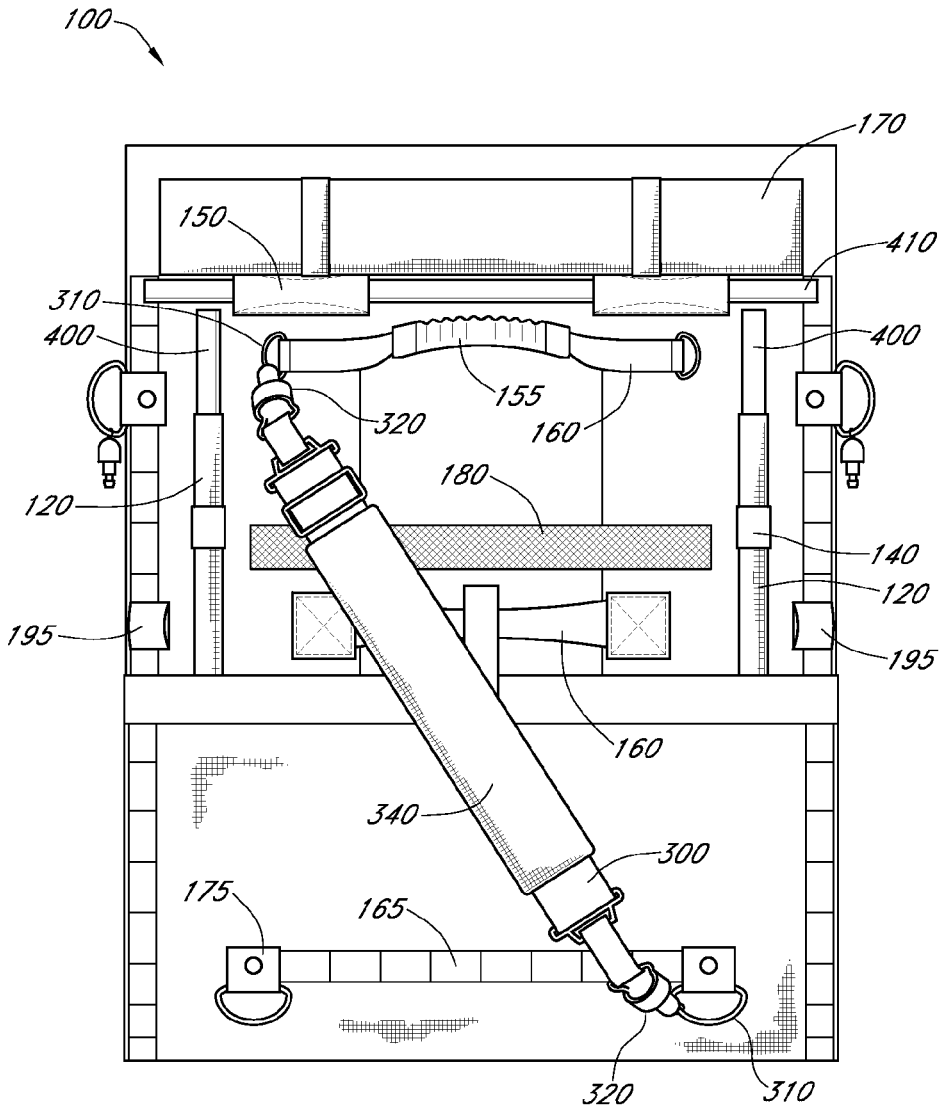
FIG. 12 shows a back view of the soft shield of FIG. 3 with a bottom portion of the shield folded and fastened and a sling fastened to the shield in a cross point application for back carry.

In still yet another configuration illustrated in FIG. 12, a sling 300 may be connected to a ring 310 on the sectional strap 165 that is on the opposite side of the shell 110 to create a diagonally oriented sling 300. This will allow the sling 300 to be placed across the chest and the shield to cover the back, similar to the back-pack style orientation while utilizing a different strap configuration.

Figure 13:
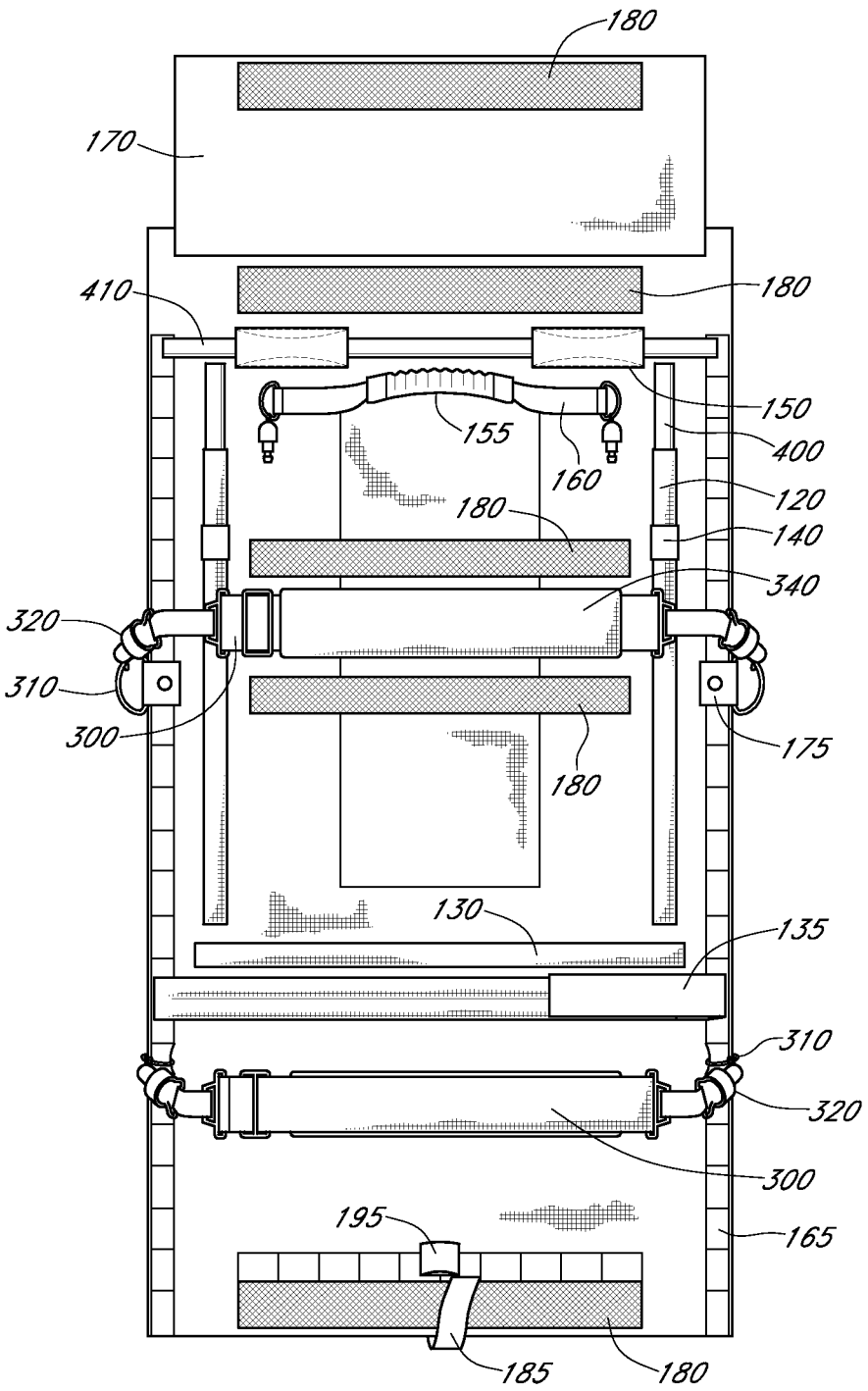
FIG. 13 shows a back view of the soft shield of FIG. 3 fully deployed with two slings attached to a middle and lower portion of the shield for, in an embodiment, medivac removal of an injured officer.

In some embodiments, the soft shield 100 may be used as a gurney. An injured officer may have his upper torso from his head to the bottom of his rear end placed on the shield, and then two slings 300 may be used to secure the officer. Four handles 160 may be added to the soft shield 100 at four locations, for example the four corners, to allow the officer and the soft shield 100 to be lifted out. Also, the 170 flap could be used to drag the soft shield 100 and the officer. FIG. 13 illustrates an embodiment of the soft shield 100 for use in a tactical medical application using two slings 300 to be slung around the chest and hip area to allow for medivac removal of an injured officer. In this configuration the soft shield 100 is unfolded and fully deployed, and the two slings 300 are connected to sectional strap 165 rings 310 in a horizontal orientation. As can be seen the ability to apply sectional straps 165 and rings 310 to almost anywhere on the shell 110, including attaching the rings 310 to the handles 160, allows for a multitude of different sling 300 orientations that can accommodate a wide range of situations, and allow the soft shield 100 to be worn by an officer in a number of positions and cover the body in many different ways.

The soft shield 100 may also include one or more small pockets 195 installed along one or more outer edges of the soft shield 100. The small pockets 195 may allow the soft shield 100 to be used as a ballistic block, for example for windows and attics. An end of a pole may be placed in the small pocket 195, and then the soft shield 195 may be lifted up on the end of the pole. This may be useful in some tactical situations. For example, officers that are normally posted with rifles at windows may create a tactical problem for entry teams. The soft shield 100 may be held on the pole to block a good portion of the window. If an officer climbs a ladder and attempts to search an attic, another officer can place a long pole into a small pocket 195 and use the pole to hold the soft shield 100 behind the searching officer's head to provide ballistic protection. In another embodiment the small pocket 195 may provide lean back capability. In an embodiment a rod, pole or other elongate structure may be placed it in the pocket and the soft shield 100 can then be leaned back in order to give ballistic protection to an officer in a prone position.

The soft shield 100 may also include a light source. The light source may be attached to the carrier by a hook-and-loop or other fastener 180. The actuator wire and battery pack wire may run through a small hole made in the shell 110 and run around the one or more ballistic panels 200 to avoid making a hole in the ballistic panels 200 and be in compliance with NIJ construction requirements. The actuator wire may exit the back side of the shell 110 and may be attached to the upper horizontal support 410. The battery pack wire may also exit the back side of the shell 110 and be inserted into the attached battery pack. The battery pack may be stored in a small pocket in the shell 110. This pocket may be located just above the horizontal support 410 and may be positioned to reduce or eliminate interference with the rolling up of the soft shield 100.

The soft shield 100 may include a ballistic viewport. In some embodiments, the ballistic panel 200 preferably is cut to allow for the installation of the ballistic viewport. An outer frame may be attached around the ballistic viewport and may be inserted in between the layers of ballistic material to allow for an overlap. This overlap may restrict penetration around the meeting of the ballistic material and the ballistic viewport.

Magnets may be added to the flap 170, the shell 110, or external rigging device of the soft shield 100 to allow the soft shield 100 to be attached to metal security doors on homes and other structures. This mounting may allow a door breacher to be protected while accomplishing his task.

In one embodiment, a ballistic barrier outer carrier comprises a plurality of pockets that the soft shields 100 can be inserted into for the purpose of creating a ballistic barrier for SWAT teams or bomb squads. The pockets may be linearly arranged, and the seam area where the soft shields 100 meet may have strips of ballistic material, for example strips of ballistic material sewn to the outside of the shell 110, to provide the overlap needed to prevent penetration from a bullet. Alternatively, the soft shields 100 may be arranged to overlap each other to provide the necessary coverage. In some other embodiments, multiple soft shields 100 can be coupled together to provide a larger protected area without the use of an outer carrier.

Another carrier may hold one or more soft shields 100 to provide a ballistic wrap for a vehicle, such as a Bearcat armored vehicle. The seam area between the soft shields 100 may be protected by ballistic material that overlaps the edges of the soft shields 100. The wrap may be suspended from the step-up ramp to the ground. It may also be suspended from the upper hold-on bars at the top of the Bearcat. This wrap may help prevent bullets from skipping under the vehicle and striking SWAT team members.

Figure 15:
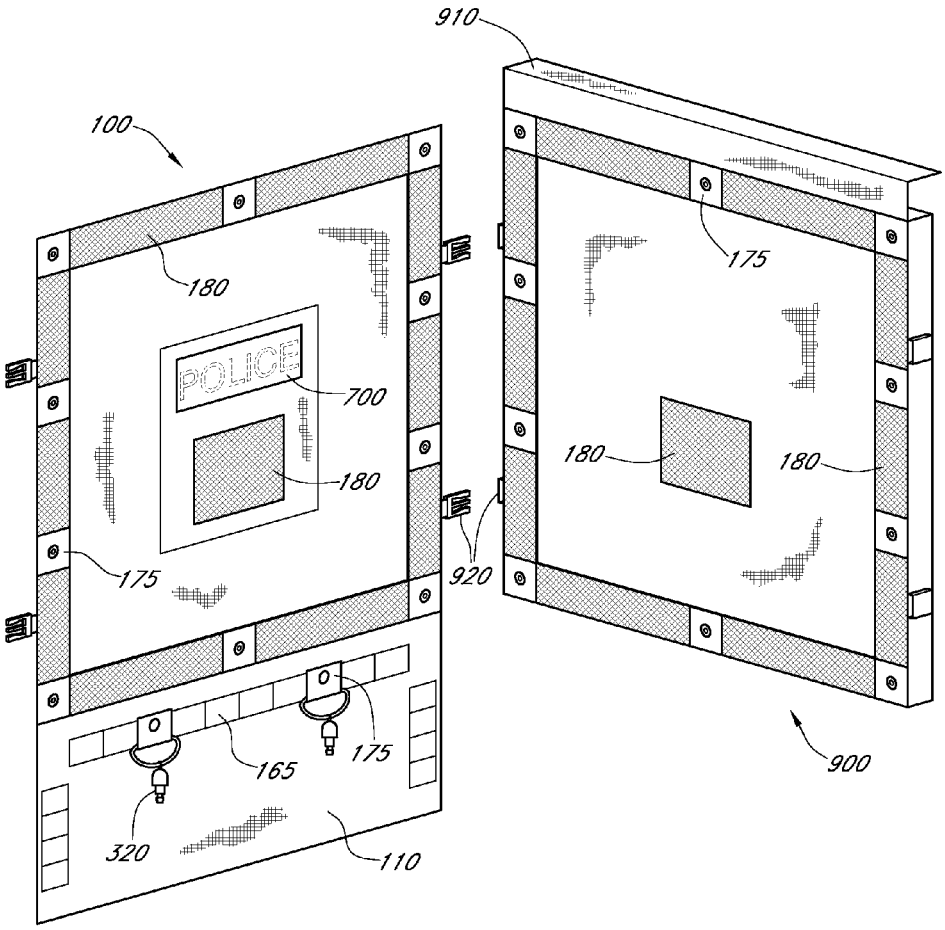
FIG. 15 shows a view of a soft shield with a sleeve to optionally insert hard armor to convert the soft shield into a combination hard and soft shield.

FIG. 15 illustrates another embodiment in which the soft shield 100 may contain a ballistic sleeve 900, for storing of hard armor that may convert at least a portion of the soft shield 100 into a hard shield. In an embodiment, the ballistic sleeve 900 is either inside the shell 110 or on the front side of the shell 110. The hard armor may be a level III certified hard armor insert. In an embodiment, the ballistic sleeve 900 may be about as wide as the shell 110 but only a portion of the length, for example, half the length. In one embodiment the ballistic sleeve 900 may be approximately 20 inches wide×28 inches in length. This advantageously allows an operator to insert hard armor material, for example, compressed polyethylene, into the ballistic sleeve 900. In an embodiment, this will allow the portion of the shield 100 with the hard material to be converted into a hard shield. In an embodiment, the upper half of the soft shield 100 would contain the ballistic sleeve 900 so the top half of the soft shield 100 could be converted into a hard shield. This would allow the user to remove the horizontal supports 410 and the vertical supports 400 if desired, as the hard material would provide sufficient structure to cover the torso of an operator, while the remaining portion of the soft shield's 100 shell 110 would drape below and the legs of the operator would provide the support to keep the lower half in place during engagement. In some embodiments horizontal and vertical supports 410 and 400 may not be provided.

In an embodiment, the ballistic sleeve 900 would have a sleeve flap 910 to removably store hard armor inside the ballistic sleeve 900. In an embodiment, the ballistic sleeve 900 may contain fasteners 800 and snap on connectors 175 for attachment of the ballistic sleeve 900 to the soft shield 100. In an embodiment, the soft shield 100 contains fasteners 800 and snap on connectors 175 on the front side or the back side of the soft shield 100 that may connect the fasteners 800 and snap on connectors 175 of the ballistic sleeve 900 in order to removably secure the ballistic sleeve 900 to the soft shield. In an embodiment, there may be added fasteners 800, for example VELCRO® on any portion of the ballistic sleeve 900 and corresponding location on the soft shield 100 in order to provide adequate support.

In an embodiment, the ballistic sleeve 900 may be permanently attached to the soft shield 100 by sewing or other means known in the art. In one embodiment, the ballistic sleeve 900 may be a bellows pocket that is sewn on to the front of the shell 110 or may be a flat pocket sewn on to the front of the shell 110. In an embodiment in which the ballistic sleeve 900 is a flat pocket, it is preferably bigger than the inserted hard armor. In an embodiment, the ballistic sleeve 900 is a bellows pocket about 20×28 inches that can carry hard armor that measures about 20×28 inches.

In an embodiment, the ballistic sleeve 900 and soft shield 100 also contain components of a securing connection 920 to further secure the ballistic sleeve 900 to the soft shield 100. In an embodiment the securing connection 920 is a fastex fastener buckle and strap system, which the male or female end of the buckle attached via a strap or other tether to either the ballistic sleeve 900 or the soft shield 100 and the counterpart attached with straps or other tether to either the ballistic sleeve 900 or the soft shield 100. In an embodiment, the securing connection 920 may be any other suitable strap system, belt strap, or other connection known in the art that may provide further support when removably securing the ballistic sleeve 900 to the soft shield 100.

Advantageously, in an embodiment, the addition of hard armor allows added protection against increasingly powerful rounds. In an embodiment, the ballistic panels 200 may be kept inside the soft shield 100 when the ballistic sleeve 900 and hard armor is added to the soft shield 100. This will allow a relatively lighter amount of hard armor to be added to still be certified under level III and stop, in some embodiments, 223, AK47, 308, 30-06, and 300 Win Mag rounds. The combination of soft ballistic protection and hard armor will allow the shield to be overall much lighter compared to a shield that relied entirely on hard armor to protect the user. In other embodiments, the soft shield 100 and ballistic sleeve 900 may be used without the ballistic panels 200 and rely only on the hard armor for ballistic protection.

In some embodiments, the uses of the soft shield 100 include at least one or more of the following: active shooter response, SWAT, maritime ship-boarding, school and classroom safety, sniper protection, officer down drills, court services, felony car stops and takedowns, dignitary protection, and political bodies (council chambers, judges benches, etc). In some embodiments, the benefits of the soft shield 100 include at least one or more of the following: easy storage and access, quick deployment, absorbs impact from rounds and physical attacks, waterproofed ballistics, generally forms to the body of the wearer, and hands-free use enabling full weapons use and hands-on ability.

The advantages of the soft shield 100 include one or more of the following: soft shields 100 may roll up to facilitate storage. Soft shields 100 may be adjusted to different lengths and therefore adjusted for different uses (tunnels, boats, deployment). Soft shields 100 may be forgiving when bumped into things and may be quiet. Soft shields 100 may be stood on when a SWAT team repels down an elevator shaft to rescue a hostage in an elevator and needs ballistic protection from a shooter below. Soft shields 100 may conform to the body when entering narrow passage ways or aisles on buses and planes. Soft shields 100 may mitigate abuse since they are soft. Soft shields 100 may be lighter and more forgiving when carried than a hard shield. This may allow for prolonged searches or standoffs. Many tasks may be done with one or no hands supporting the soft shield 100 since the soft shield 100 may be held around the neck by a sling 300. The varying lengths of the soft shield 100 may facilitate use by officers of different heights. If a shorter officer uses the soft shield 100 at a full 40 inch length, the shield may lay itself out on the ground if necessary and not bother or impede the officer. Soft shields 100 can be upgraded, for example by sewing additions to it, like the front side plate pocket 600 or the sectional straps 165, or pockets to place additional magazines of ammunition, etc. Soft shields 100 may employ other features of a hard shield, for example the light source or the ballistic viewport. Soft shields 100 may be easily used with different weapons systems including a rifle as shown in FIG. 14. In this embodiment, the sling may hold the soft shield 100 up while the rifle barrel sits across the top of the soft shield 100 and the trigger and operating mechanism remains behind the soft shield 100. This allows the operator to safely fire the gun from behind the soft shield 100 without exposing the operator's arms and hands to gunfire.

Soft shields 100 may not detract from the speed and agility necessary to perform the police role. In an officer down drill, an injured officer must be rescued from an active shooter situation. One or more soft shields 100 may be draped on a police vehicle, and the officers may use the soft shields 100 to provide themselves ballistic protection by arranging the soft shields 100 to the same side of their bodies as the threat. The sling 300 on the soft shield 100 may allow for this placement, even for positioning of the soft shield 100 at the officer's side. All four sides of the human body may accommodate the soft shield 100, for example by hanging the soft shield 100 with the sling 300 around the neck.

Although the foregoing invention has been described in terms of certain embodiments, other embodiments will be apparent to those of ordinary skill in the art from the disclosure herein. Moreover, the described embodiments have been presented by way of example only, and are not intended to limit the scope of the inventions. Indeed, the novel methods and systems described herein may be embodied in a variety of other forms without departing from the spirit thereof. Accordingly, other combinations, omissions, substitutions and modifications will be apparent to the skilled artisan in view of the disclosure herein.

What is claimed is:

1. A ballistic shield for protecting law enforcement officers from bodily harm from projectiles comprising:

a shell configured to support at least one ballistic panel made from a ballistic material suitable for protecting a user from bodily injury from projectiles, the shell having four sides;

at least four support rods, wherein two support rods are configured to be oriented in a generally vertical direction when in a deployed configuration and two of the support rods configured to be oriented in a generally horizontal direction when in a deployed configuration, the support rods adapted to form an approximately rectangular frame for supporting the shell near the four sides of the shell;

at least one elastic band coupled to an upper portion of the shell and adapted to secure a top one of the two support rods oriented in a generally horizontal direction to the shell in a deployed configuration;

first and second nearly full length rod pockets coupled to first and second side portions of the shell and oriented in a generally vertical direction when in a deployed configuration; the first and second rod pockets being adapted to secure the two support rods oriented in a generally vertical direction to the shell when in a deployed configuration, the first and second rod pockets having openings near the top portions of the pockets for insertion and removal of the two support rods;

a third rod pocket coupled to a lower portion of the shell and adapted to secure a bottom one of the two support rods oriented in a generally horizontal direction to the shell, the third rod pocket supporting the bottom one of the two support rods oriented in a generally horizontal direction when in a deployed configuration;

a generally horizontally oriented storage pocket coupled to the shell for storage of the two support rods configured to be oriented in a generally vertical direction, when not deployed in the generally vertical direction;

a flap coupled near a top of the shell with fasteners on the flap and on the shell to enable the shield to be secured to an object;

at least one handle coupled to the shell for arm carrying and holding the shield;

at least first and second rings attached to ends of the handle coupled to the shell;

a sling having a first end and a second end, each end of the sling adapted to be coupled to one of the first and second rings by a quick release connection mechanism; and a front side plate pocket coupled with the shell and adapted to support a hard armor plate to protect against higher powered projectiles.

2. The ballistic shield for protecting law enforcement officers from bodily harm from projectiles of claim 1 wherein the at least one elastic band forms at least a part of a centering mechanism comprising first and second end caps elastically coupled to a portion of the shield and configured to be removably placed over first and second ends of the at least one elongate generally horizontal support.

3. The ballistic shield for protecting law enforcement officers from bodily harm from projectiles of claim 1 wherein the at least one elastic band is coupled to the shell and coupled with at least one a retainer cap configured to be positioned over an end of the at least one elongate generally horizontal support.

4. A shield for protection of law enforcement officers comprising:

a shell adapted to support at least one ballistic panel made from a ballistic material suitable for protecting a user from bodily injury from projectiles, the shell having a stored configuration and at least first and second deployed configurations;

at least one elongate generally horizontal support associated with the shell made from a semi-rigid material and capable of supporting the shell to absorb the impact of a projectile;

at least two elongate generally vertical supports constructed of a semi-rigid material and capable of supporting the shell to absorb the impact of a projectile; and at least two generally vertical pockets coupled to the shell that house the at least two generally vertical supports in the deployed configurations, wherein the generally vertical pockets provide support to the shell when the generally vertical supports are housed inside the generally vertical pockets;

at least one pocket coupled to the shell adapted to store the at least two elongate generally vertical supports when the shell is in the stored configuration;

a foldable shield portion coupled to a lower portion of the shell, the foldable shield portion being adapted to be folded up in the first deployed configuration to provide a shield of a first length, and the foldable shield portion being adapted to be unfolded in the second deployed configuration to provide a shield of a second length, the second length being greater than the first length; and a centering mechanism comprising first and second end caps elastically coupled to a portion of the shield and configured to be removably placed over first and second ends of the at least one elongate generally horizontal support.

5. The ballistic shield for protecting law enforcement officers of claim 4 wherein the first and second generally vertical supports are rods.

6. The ballistic shield for protecting law enforcement officers of claim 4 wherein the first and second generally vertical pockets have an opening near the top.

7. The ballistic shield for protecting law enforcement officers of claim 4 wherein the first and second generally vertical pockets cover most of the generally vertical supports in the deployed configuration.

8. The ballistic shield for protecting law enforcement officers of claim 4 wherein the shell comprises ballistic nylon.

9. The ballistic shield for protecting law enforcement officers of claim 4 wherein at least one elastic band is coupled to at least one of the first and second generally vertical pockets.

10. The ballistic shield for protecting law enforcement officers of claim 4 wherein the first and second generally vertical pockets are angled relative to an edge portion of the shell.

11. The ballistic shield for protecting law enforcement officers of claim 4 wherein upper portions of the first and second generally vertical pockets are flared.

12. The ballistic shield for protecting law enforcement officers of claim 4 comprising a flap coupled near a top of the shell with fasteners on the flap and on the shell to enable the shield to be secured to an object.

13. The ballistic shield for protecting law enforcement officers of claim 4 comprising a hard armor plate configured to be coupled to the shell.

14. A ballistic shield for protecting law enforcement officers from bodily harm from projectiles comprising:

a shell adapted to support at least one ballistic panel made from a ballistic material suitable for protecting a user from bodily injury from projectiles;

at least one generally horizontal support adapted to be coupled to the shell for providing support to the ballistic shield when the ballistic shield is in a deployed configuration;

first and second generally vertical supports adapted to be coupled to the shell for providing support to the ballistic shield when the ballistic shield is in a deployed configuration;

first and second generally vertical pockets for removably housing the first and second generally vertical supports coupled to the shell, the first and second generally vertical pockets cover a majority of the first and second generally vertical supports when housing the first and second generally vertical supports in a deployed configuration to provide a support structure for the ballistic shield to absorb energy from an impact of a projectile; and a retainer cap coupled to the shield and configured to be positioned over an end of the at least one elongate generally horizontal support.

15. The ballistic shield for protecting law enforcement officers of claim 14 comprising a generally horizontal storage pocket adapted to store at least one of the first and second generally vertical supports when in a stored configuration.

16. The ballistic shield for protecting law enforcement officers of claim 14 wherein the shell has at least one small pocket near an edge portion of the shell adapted to receive an end of a pole for supporting the shield in an elevated position for a tactical maneuver.

17. The ballistic shield for protecting law enforcement officers of claim 14 comprising at least one handle coupled to the shell for arm carrying and holding the shield.

18. The ballistic shield for protecting law enforcement officers of claim 14 comprising a sling having a first end and a second end, each end of the sling adapted to be coupled to the shell by a quick release connection mechanism.

19. The ballistic shield for protecting law enforcement officers of claim 14 comprising a front side plate pocket coupled with the shell and adapted to support a hard armor plate to protect against higher powered projectiles.

20. The ballistic shield for protecting law enforcement officers of claim 14 comprising a foldable shield portion coupled to a lower portion of the shell, the foldable shield portion being adapted to be folded up in a first deployed configuration to provide a shield of a first length, and the foldable shield portion being adapted to be unfolded in a second deployed configuration to provide a shield of a second length, the second length being greater than the first length.

* * * * *